US011642769B2

(12) United States Patent
Yoshikane et al.

(10) Patent No.: US 11,642,769 B2
(45) Date of Patent: May 9, 2023

(54) POWER TOOL HAVING A HAMMER MECHANISM

(71) Applicant: MAKITA CORPORATION, Anjo (JP)

(72) Inventors: Kiyonobu Yoshikane, Anjo (JP); Yoshitaka Machida, Anjo (JP); Taro Hisano, Anjo (JP); Kazuki Nakagawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/668,036

(22) Filed: Feb. 9, 2022

(65) Prior Publication Data

US 2022/0266432 A1 Aug. 25, 2022

(30) Foreign Application Priority Data

Feb. 22, 2021 (JP) ..... JP2021-026181
Feb. 22, 2021 (JP) ..... JP2021-026184

(51) Int. Cl.
*B25D 16/00* (2006.01)
*B25F 5/02* (2006.01)
(Continued)

(52) U.S. Cl.
CPC ..... *B25D 16/00* (2013.01); *B25D 17/24* (2013.01); *B25F 5/02* (2013.01); *B25D 17/00* (2013.01);
(Continued)

(58) Field of Classification Search
CPC ..... B25D 16/00; B25D 17/00; B25D 17/24; B25D 2211/003; B25D 2211/006;
(Continued)

(56) References Cited

U.S. PATENT DOCUMENTS 3,203,490 A * 8/1965 Short ..... B25D 16/00 173/117
3,521,497 A * 7/1970 Schmuck ..... F16H 37/16 173/109
(Continued)

FOREIGN PATENT DOCUMENTS

JP 6325360 B2 5/2018

*Primary Examiner* — Robert F Long
*Assistant Examiner* — Eduardo R Ferrero
(74) *Attorney, Agent, or Firm* — Oliff PLC

(57) ABSTRACT

A movable support at least partially supports a final output shaft and a driving mechanism, and is integrally movable relative to a housing in an axial direction of a driving axis. A biasing member biases the movable support toward a front side in the axial direction. A first guide shaft extends in the axial direction and slidably guides the movement of the movable support in the axial direction. At least one intermediate shaft rotates in response to rotation of a motor shaft and transmit power of the motor to the driving mechanism. At least one bearing supports an end portion of the at least one intermediate shaft is located in the front side in the axial direction. A single metal support is immovable relative to the housing and supports the at least one bearing. The single metal support has a first hole for partially receiving the first guide shaft.

16 Claims, 14 Drawing Sheets

(51) Int. Cl.
*B25D 17/24* (2006.01)
*B25F 5/00* (2006.01)
*B25D 17/00* (2006.01)

(52) U.S. Cl.
CPC .. *B25D 2211/003* (2013.01); *B25D 2211/006* (2013.01); *B25D 2211/061* (2013.01); *B25D 2211/068* (2013.01); *B25D 2216/0023* (2013.01); *B25D 2217/0073* (2013.01); *B25D 2217/0076* (2013.01); *B25D 2217/0092* (2013.01); *B25D 2250/121* (2013.01); *B25D 2250/245* (2013.01); *B25D 2250/331* (2013.01); *B25F 5/006* (2013.01)

(58) Field of Classification Search
CPC ..... B25D 2211/061; B25D 2211/068; B25D 2216/023; B25D 2217/0073; B25D 2217/0076; B25D 2217/0092; B25D 2222/24; B25D 2222/54; B25D 2250/121; B25D 2250/245; B25D 2250/331; B25F 5/006; B25F 5/008; B25F 5/02
See application file for complete search history.

(56) References Cited

U.S. PATENT DOCUMENTS 4,158,313 A * 6/1979 Smith ..... B25D 16/00 74/423
4,436,163 A * 3/1984 Simpson ..... A01G 3/053 411/234
4,442,906 A * 4/1984 Simpson ..... B25D 11/005 173/133
6,000,310 A * 12/1999 Shilkrut ..... B25D 17/24 173/162.1
6,015,017 A * 1/2000 Lauterwald ..... B25D 16/006 173/48
7,735,575 B2 * 6/2010 Trautner ..... B25D 16/006 173/205
8,347,981 B2 * 1/2013 Aoki ..... B25D 17/24 173/162.1
8,464,805 B2 * 6/2013 Baumann ..... B25D 17/24 173/109
8,695,724 B2 * 4/2014 Nakashima ..... B25F 5/006 173/210
8,905,154 B2 * 12/2014 Uemura ..... B25B 23/1453 173/200
9,168,649 B2 * 10/2015 Harcar ..... B25D 17/043
9,227,290 B2 * 1/2016 Clabunde ..... B24B 23/04
9,434,062 B2 * 9/2016 Kamegai ..... B25D 17/20
9,630,307 B2 * 4/2017 Ludy ..... B25D 11/04
9,771,690 B2 * 9/2017 Henke ..... E01B 29/26
2006/0289185 A1 * 12/2006 Hahn ..... B25D 17/24 173/210
2007/0017684 A1 * 1/2007 Stirm ..... B25D 17/24 173/210
2007/0039749 A1 * 2/2007 Aoki ..... B25D 17/24 173/212
2008/0029282 A1 * 2/2008 Ikuta ..... F16F 7/1005 30/392
2009/0014195 A1 * 1/2009 Lauterwald ..... B25D 16/003 173/104
2009/0032275 A1 * 2/2009 Ikuta ..... B25D 17/24 173/210
2009/0223693 A1 * 9/2009 Aoki ..... B25D 16/00 173/211
2010/0000751 A1 * 1/2010 Aoki ..... B25D 17/24 173/114
2011/0011608 A1 * 1/2011 Saur ..... B25D 11/062 173/162.2
2011/0017483 A1 * 1/2011 Baumann ..... B25D 17/24 173/162.2
2012/0055689 A1 * 3/2012 Wierer ..... B25D 17/043 173/162.2
2012/0061116 A1 * 3/2012 Aoki ..... B25B 23/1405 173/178
2012/0118598 A1 * 5/2012 Iio ..... B25D 17/24 173/162.1
2012/0255753 A1 * 10/2012 Kuhnle ..... B25F 5/006 173/162.2
2012/0261150 A1 * 10/2012 Aoki ..... B25D 16/003 173/104
2012/0267136 A1 * 10/2012 Mossnang ..... B25D 17/24 188/380
2012/0318551 A1 * 12/2012 Kuhnle ..... B25F 5/006 173/162.2
2013/0000937 A1 * 1/2013 Onoda ..... B25D 11/062 173/122
2014/0246478 A1 * 9/2014 Baber ..... A61B 17/32002 227/180.1
2015/0041170 A1 * 2/2015 Yoshikane ..... B25D 11/06 173/104
2015/0053449 A1 * 2/2015 Henke ..... E01B 29/26 173/128
2015/0144366 A1 * 5/2015 Machida ..... B25D 16/00 173/104
2015/0328760 A1 * 11/2015 Ikuta ..... B25D 17/043 173/117
2016/0052119 A1 * 2/2016 Yamada ..... B25D 17/20 173/117
2017/0106517 A1 4/2017 Machida
2017/0106518 A1 * 4/2017 Takeuchi ..... B25F 5/006
2017/0320206 A1 * 11/2017 Machida ..... B25D 17/24
2018/0001462 A1 * 1/2018 Ontl ..... B25D 17/24
2018/0001463 A1 * 1/2018 Furusawa ..... B25D 17/24
2019/0118361 A1 * 4/2019 Takeuchi ..... A61B 17/32002 227/180.1

* cited by examiner

VII – VII

VII – VII

IX – IX

POWER TOOL HAVING A HAMMER MECHANISM

TECHNICAL FIELD

The present disclosure generally relates to a power tool configured to linearly reciprocally drive a tool accessory.

BACKGROUND

A rotary hammer (hammer drill) is configured to linearly reciprocally drive a tool accessory coupled to a tool holder along a driving axis (i.e. perform a hammering operation) and to rotationally drive the tool accessory around the driving axis (i.e. perform a drilling operation). In typical rotary hammers, a motion converting mechanism for converting rotation of an intermediate shaft into linear motion is employed to perform the hammering operation, and a rotation-transmitting mechanism for transmitting rotation to the tool holder via the intermediate shaft is employed to perform the drilling operation. Such a rotary hammer is subjected to a reaction force from a workpiece against the striking force of the tool accessory during the hammering operation. The reaction force generates vibration in an extension direction of the driving axis (hereinafter also referred to as an axial direction). Vibration thus generated is transmitted to the housing of the rotary hammer and to its user.

Japanese Patent No. 6325360 discloses a structure for absorbing such vibration. Specifically, a driving mechanism for performing a hammering operation is held by a holding member configured to be slidably movable relative to the housing along a guide shaft. The holding member is biased forward (i.e. in a direction in which a striking force is applied to the workpiece) by a biasing member. When a tool accessory is subjected to a reaction force during the hammering operation, the force causes the driving mechanism and the holding member to move rearward together with the tool accessory relative to the housing. At this time, the biasing member elastically deforms and partially cushions the reaction force. This cushioning effect serves to reduce vibration to be transmitted to the housing due to the reaction force.

In typical rotary hammers including the one disclosed in the Japanese Patent No. 6325360, plastic is used to form its constituent members when possible in order to reduce the weight. For example, plastic is commonly used to form a housing defining an outer shell of a rotary hammer. Plastic is also commonly used to form a member supporting a bearing for an intermediate shaft.

SUMMARY

A power tool is disclosed in this specification. The power tool may include a final output shaft, a motor, a driving mechanism, a housing, a movable support, a biasing member, a first guide shaft, at least one intermediate shaft, at least one bearing, and a single (integral) support made of metal (hereinafter referred to as a metal support).

The final output shaft may be configured to removably hold a tool accessory. The final output shaft may also define a driving axis of the tool accessory. The motor may have a motor shaft. The driving mechanism may be configured to perform at least a hammering operation of linearly reciprocally driving the tool accessory along the driving axis by using power from the motor. The housing may accommodate the motor and the driving mechanism. The movable support may at least partially support the final output shaft and the driving mechanism. The movable support may also be configured to be integrally movable relative to the housing in an axial direction of the driving axis. When one side in the axial direction in which the final output shaft is disposed is defined as a front side and an opposite side in the axial direction in which the motor is disposed is defined as a rear side, the biasing member may bias the movable support toward the front side in the axial direction. The first guide shaft may extend in the axial direction and may be configured to slidably guide movement of the movable support in the axial direction. The at least one intermediate shaft may extend in the axial direction. The at least one intermediate shaft may also be configured to rotate in response to rotation of the motor shaft and transmit the power of the motor to the driving mechanism. The at least one bearing may support an end portion of the at least one intermediate shaft, that is located in the front side in the axial direction (hereinafter referred to as a front end portion). The single metal support may be disposed to be immovable relative to the housing and may support the at least one bearing. The single metal support may also have a first hole for partially receiving the first guide shaft.

The first guide shaft may also be configured to move together with the movable support in the axial direction. In this case, the first guide shaft may be received in the first hole of the metal support so as to be slidable within the first hole when the movable support moves in the axial direction. Alternatively, the first guide shaft may be immovably received in the first hole of the metal support. In this case, the first guide shaft held by the metal support may be slidably received in a hole formed in the movable support.

According to the above-described power tool, the at least one bearing for supporting the front end portion of the at least one intermediate shaft is supported by the metal support. This provides stronger support strength compared to the case in which a support made of plastic (hereinafter simply referred to as a plastic support) is used to support the at least one bearing. Therefore, even if high power operation of the power tool results in increased vibration generated due to a reaction force against the striking force, the positional accuracy for the at least one intermediate shaft can be maintained at the required level. Further, according to the power tool of this aspect, the first guide shaft is partially received in the first hole of the metal support. Therefore, even if high power operation of the power tool results in an increased amount of heat produced when the first guide shaft slidably guides movement of the movable support in the axial direction, the support can have reduced thermal expansion compared to the case in which a plastic support is used to receive the first guide shaft. Therefore, the positional accuracy for the first guide shaft partially received in the first hole of the metal support can be maintained at the required level. This in turn provides satisfactory sliding property related to the first guide shaft and also allows for satisfactory isolation of vibration. As such, the power tool of the present aspect can achieve both high power operation and reduced vibration. Moreover, the use of the single metal support for supporting the at least one bearing and also for receiving the first guide shaft enables simplified tool structure as well as reduced man-hours related to manufacturing.

DETAILED DESCRIPTION OF THE EMBODIMENTS

Figure 1:
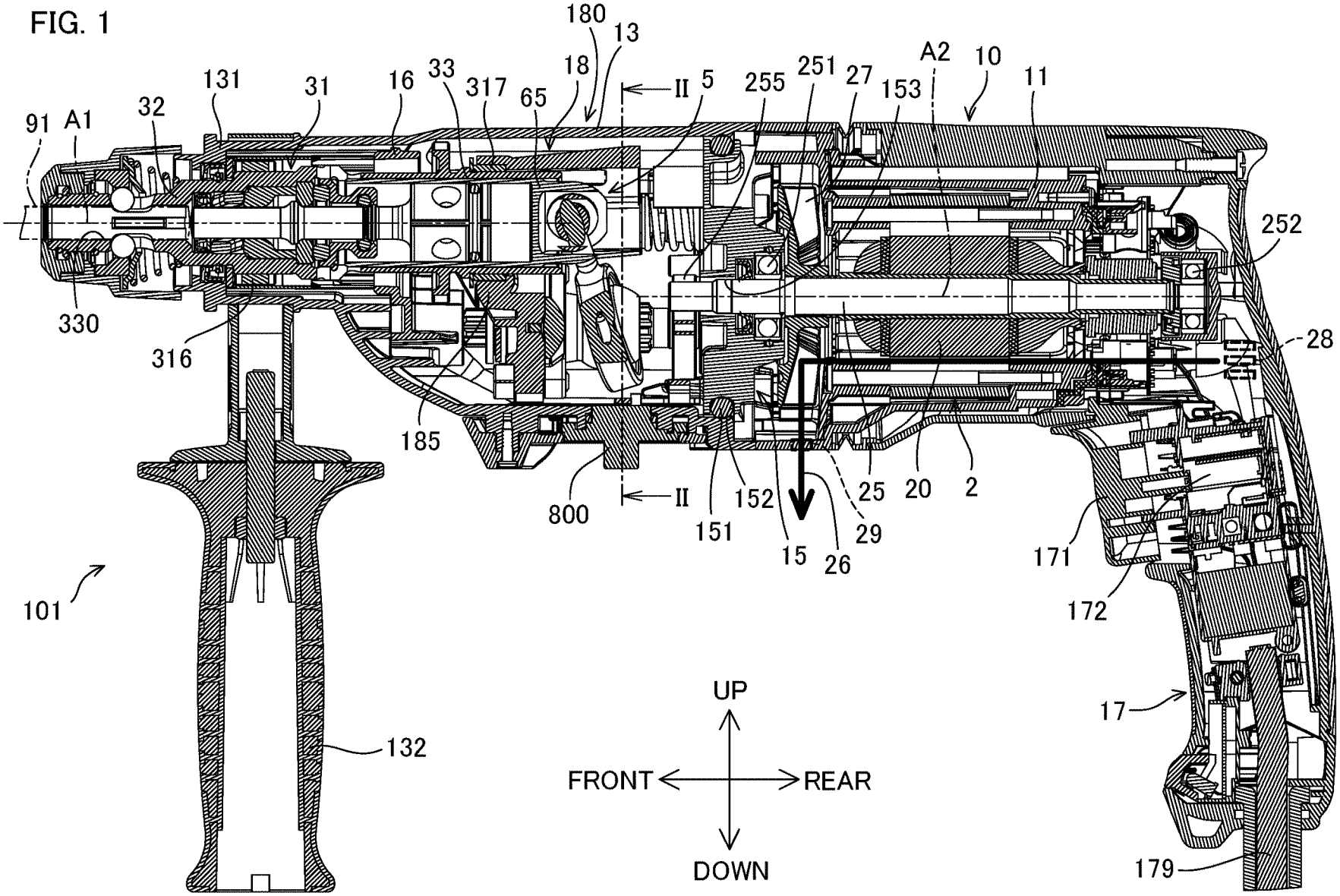
FIG. 1 is a sectional view of a rotary hammer according to one embodiment of the present disclosure.

In one or more of embodiments, the housing may be made of plastic. The metal support may be fixed to the housing. According to the present embodiment, the power tool can achieve both high power operation and reduced vibration while successfully having a reduced weight.

In one or more embodiments, the metal support may include a first positioning part in the front side. The first positioning part is disposed so as to circumferentially surround the final output shaft. The housing may include a second positioning support also disposed so as to circumferentially surround the final output shaft. The first positioning part and the second positioning part may be shaped to be fitted with each other in the axial direction. According to the present embodiment, the first and second positioning parts can be aligned and fitted with each other in the process of assembling the power tool. This enables easy positioning of the metal support relative to the housing in a direction orthogonal to the axial direction.

In one or more embodiments, the metal support may include an attachment surface in the front side. The attachment surface spreads in form of a single plane at a position radially outward of the first positioning part. The attachment surface may abut on the housing in the axial direction. According to the present embodiment, the attachment surface can be abutted on the housing in the axial direction in the process of assembling the power tool. This enables easy positioning of the metal support relative to the housing in the axial direction.

In one or more embodiments, the first guide shaft may be disposed so as to be at least partially in the front side of the movable support. The power tool may further include a second guide shaft that is disposed so as to be at least partially in the rear side of the movable support and coaxial with the first guide shaft. According to the present embodiment, the distance over which the guide shafts extend as a whole can be shortened compared to a case in which a single guide shaft extends from where the first guide shaft is to where the second guide shaft is. The rotary hammer can thus have a reduced weight. Moreover, since the guide shafts are respectively placed on both sides of the movable support in the axial direction, the movable support can be guided satisfactorily irrespective of the reduced weight.

In one or more embodiments, the first guide shaft may extend frontward from the movable support. The first guide shaft may be configured to move together with the movable support in the axial direction. According to the present embodiment, the sliding property related to the first guide shaft can be maintained satisfactory.

In one or more embodiments, the metal support may include a first sleeve within the first hole. The first sleeve is made of iron-based metal. The first guide shaft may be configured to slide on an inner peripheral surface of the first sleeve while the movable support moves in the axial direction. The metal support may be made of aluminum-based metal except for the first sleeve. Examples of the iron-based metal include iron and any alloy that contains iron as its main component. Examples of the aluminum-based metal include aluminum and any alloy that contains aluminum as its main component. According to the present embodiment, the metal support can have sufficient strength to withstand sliding movement relative to the guide shaft and can also have a reduced weight as a whole.

In one or more embodiments, the movable support may include a second hole for partially receiving the second guide shaft, and a second sleeve disposed within the second hole. The second guide shaft may be disposed so as to be immovable relative to the housing. An inner peripheral surface of the second sleeve may be configured to slide on the second guide shaft while the movable support moves in the axial direction. The biasing member may be disposed around the second guide shaft in the rear side of the movable support in the axial direction, and may be configured to bias the movable support including the second sleeve integrally frontward. According to the present embodiment, only the second sleeve, among all the parts constituting the movable support, slides on the second guide shaft. Therefore, making the second sleeve from a selected material of sufficient strength can lead to smooth sliding property. Also, since the second sleeve is biased frontward by the biasing member, the sleeve can be prevented from being left behind and off the second hole while the movable support moves frontward.

In one or more embodiments, the driving mechanism may further be configured to perform a drilling operation of rotationally driving the tool accessory around the driving axis by using power from the motor. The at least one intermediate shaft may include a first intermediate shaft configured to transmit power for the hammering operation to the driving mechanism, and a second intermediate shaft configured to transmit power for the drilling operation to the driving mechanism. The at least one bearing may include a first bearing for supporting the first intermediate shaft, and a second bearing for supporting the second intermediate shaft. The first intermediate shaft may be configured to transmit power for the hammering operation but not for the drilling operation; whereas the second intermediate shaft may be configured to transmit power for the drilling operation but not for the hammering operation. According to the present embodiment, the first intermediate shaft and the second intermediate shaft can be made shorter compared to the case in which one common intermediate shaft is used for both the hammering operation and the drilling operation.

Thus, the overall length of the rotary hammer can be reduced in the driving-axis direction. Further, the first intermediate shaft and the second intermediate shaft are respectively dedicated for power transmission for the hammering operation and power transmission for the drilling operation. This optimizes power transmission via the first intermediate shaft and power transmission via the second intermediate shaft to the final output shaft, respectively.

In one or more embodiments, the first bearing and the second bearing may be disposed at positions different from each other in the axial direction. According to the present embodiment, the positions of the first and second bearings may be set without any constraints from the metal support. Therefore, the positions of the first and second bearings can be set so as not to damage the effect of having shorter first and second intermediate shafts. In other words, increase in length of the rotary hammer due to the use of the metal support is reduced or eliminated.

The embodiment of the present disclosure is now described in more detail with reference to the drawings.

In this embodiment, a rotary hammer (hammer drill) 101 is described as an example of a power tool according to the present teachings. The rotary hammer 101 is a hand-held power tool that may be used for processing operations such as chipping and drilling. The rotary hammer 101 is configured to be capable of performing the operation (hereinafter referred to as a hammering operation) of linearly reciprocally driving a tool accessory 91 along a driving axis A1 and of performing the operation (hereinafter referred to as a drilling operation) of rotationally driving the tool accessory 91 around the driving axis A1.

First, the general structure of the rotary hammer 101 is described with reference to FIG. 1. As shown in FIG. 1, an outer shell of the rotary hammer 101 is mainly formed by a body housing 10 and a handle 17 connected to the body housing 10.

The body housing 10 is a hollow body which may also be referred to as a tool body or an outer shell housing. The body housing 10 houses parts such as a spindle 31, a motor 2, a driving mechanism 5, and the like. The spindle 31 is an elongate member having a hollow circular cylindrical shape. At its end portion in the axial direction, the spindle 31 has a tool holder 32 configured to removably hold the tool accessory 91. A longitudinal axis of the spindle 31 defines a driving axis A1 of the tool accessory 91. The body housing 10 extends along the driving axis A1. The tool holder 32 is disposed within one end portion of the body housing 10 in an extension direction of the driving axis A1 (hereinafter simply referred to as a driving-axis direction).

The handle 17 is an elongate hollow body configured to be held by a user. One axial end portion of the handle 17 is connected to the other end portion (an end portion located on the side opposite to the side in which the tool holder 32 is located) of the body housing 10 in the driving-axis direction. The handle 17 protrudes from the other end portion of the body housing 10 and extends in a direction crossing (more specifically, generally orthogonal to) the driving axis A1. Further, in this embodiment, the body housing 10 and the handle 17 are integrally formed by a plurality of components connected together with screws or the like. A power cable 179 extends from the protruding end of the handle 17 and can be connected to an external alternate current (AC) power source. The handle 17 has a trigger 171 to be depressed (pulled) by a user, and a switch 172 configured to be turned ON in response to a depressing operation of the trigger 171.

In the rotary hammer 101, when the switch 172 is turned ON, the motor 2 is energized and the driving mechanism 5 is driven so that the hammering operation and/or the drilling operation is performed.

The detailed structure of the rotary hammer 101 is now described. In the following description, for convenience sake, the extension direction of the driving axis A1 (the longitudinal direction of the body housing 10) is defined as a front-rear direction of the rotary hammer 101. The side of one end of the rotary hammer 101 in the front-rear direction in which the tool holder 32 is disposed is defined as a front side of the rotary hammer 101; whereas the opposite side (the side in which the motor 2 is disposed) is defined as a rear side of the rotary hammer 101. The direction that is orthogonal to the driving axis A1 and corresponds to an axial direction of the handle 17 is defined as an up-down direction of the rotary hammer 101. In the up-down direction, the side of one end of the handle 17 that is connected to the body housing 10 is defined as an upper side and the side of the protruding end of the handle 17 is defined as a lower side. Further, the direction that is orthogonal to both the front-rear direction and the up-down direction is defined as a left-right direction of the rotary hammer 101. In the left-right direction, the side to the right when viewed from the rear side to the front side is defined as a right side of the rotary hammer 101 and the opposite side is defined as a left side of the rotary hammer 101.

First, the structure of the body housing 10 is described. As shown in FIG. 1, the body housing 10 has a front end portion of a hollow circular cylindrical shape. The portion is referred to as a barrel part 131. The remaining portion of the body housing 10 other than the barrel part 131 has a generally rectangular box-like shape. An auxiliary handle 132 is removably attachable to the barrel part 131.

The internal space of the body housing 10 is partitioned into two volumes by a first support 15 that is disposed within the body housing 10. The first support 15 is arranged to cross the driving axis A1, is fitted into an inner periphery of the body housing 10, and is fixedly held by the body housing 10 (so as to be immovable relative to the body housing 10). The volume in the rear of the first support 15 is a volume (space) for mainly housing the motor 2. The volume in front of the bearing support 15 is a volume (space) for mainly housing the spindle 31 and the driving mechanism 5. In the following description, the portion of the body housing 10 that corresponds to the region for housing the motor 2 is referred to as a rear housing 11, and the portion (including the barrel part 131) of the body housing 10 that corresponds to the region for housing the spindle 31 and the driving mechanism 5 is referred to as a front housing 13.

The rear housing 11 and the front housing 13 are both formed of plastic. The rotary hammer 101 can thus have a reduced weight. The rear housing 11 and the front housing 13, however, may at least partially be formed of a freely-selected material (e.g., metal). Each of the rear housing 11 and the front housing 13 is a single tubular member.

The first support 15 is a member for supporting bearings of various shafts. Details of the first support 15 will be described later. To provide a required level of positional accuracy for the bearings, the first support 15 is formed of metal. In this embodiment, the first support 15 is formed of aluminum-based metal. The rotary hammer 101 can thus have a reduced weight. As shown in FIG. 1, the first support 15 is fitted into a rear end portion of the front housing 13 so that an outer peripheral surface of the first support 15 comes into contact with an inner peripheral surface of the front housing 13.

As shown in FIG. 1, an annular groove 152 is formed on the outer peripheral surface of the first support 15 that is in contact with the inner peripheral surface of the body housing 11. A rubber O-ring 151 is fitted in this groove 152. The O-ring 151 serves as a seal member for sealing a gap between the body housing 10 and the first support 15, and prevents lubricant used within the front housing 13 from leaking into the rear housing 11.

The internal structures of the body housing 10 are now described. First, the motor 2 is described. In this embodiment, an AC motor, which may be powered by an external AC power source, is employed as the motor 2. As shown in FIG. 1, the motor 2 is fixed to the rear housing 11. The motor 2 has a body 20 including a stator and a rotor, and a motor shaft 25 configured to rotate together with the rotor. In this embodiment, a rotation axis A2 of the motor shaft 25 extends below the driving axis A1 and in parallel to the driving axis A1.

The motor shaft 25 is supported via two bearings 251 and 252 so as to be rotatable around the rotation axis A2 relative to the body housing 10. The front bearing 251 is held on a rear surface side of the first support 15, and the rear bearing 252 is held by the rear housing 11.

A cooling fan 27 for cooling the motor 2 is fixed to a portion of the motor shaft 25 between the body 20 and the front bearing 251. The cooling fan 27 is a centrifugal fan and is configured to suck air in the axial direction and discharge the air radially outward. Rotation of the motor shaft 25 and thus of the fooling fan 17 produces a flow of air inside the rotary hammer 101. The air flows from outside the rotary hammer 101 through an inlet opening 28 into the rotary hammer 101, goes through the motor 2 (more specifically, between the rotor and the stator) in the axial direction, and then is directed radially outward by the cooling fan 27 and discharged outside through a discharge opening 29. The passage for the thus produced flow of air is shown by an arrow 26 in FIG. 1.

In the example shown in FIG. 1, the inlet opening 28 is formed on a side surface of the handle 17, and the discharge opening 29 is formed on a bottom surface of the rear housing 11. The inlet opening 28 and the discharge opening 29 may, however, be formed in freely-selected locations. For example, the inlet opening 28 may be formed on an upper surface of the handle 17 in addition to or instead of the side surface of the handle 17. Also, the discharge opening 29 may be formed on one or both side surfaces or on an upper surface of the rear housing 11 in addition to or instead of the bottom surface of the rear housing 11. The flow of air thus generated serves to cool the motor 2.

The first support 15 is disposed adjacent to the cooling fan 27 in the front-rear direction. The space in the rear of the first support 15 is in communication with a space in which the cooling fan 27 is disposed. Moreover, in this embodiment, the first support 15 is formed of metal. Therefore, the flow of air going through the passage 26 also serves to cool the first support 15. In other words, the first support 15 is arranged such that heat generated in the front side of the first support 15 and transmitted to the first support 15 can be dissipated. Details of this function will be described later.

A front end portion of the motor shaft 25 extends through a through hole 153 of the first support 15 and protrudes into the front housing 13. A pinion gear 255 is fixed to this end portion of the motor shaft 25 that protrudes into the front housing 13.

Figure 2:
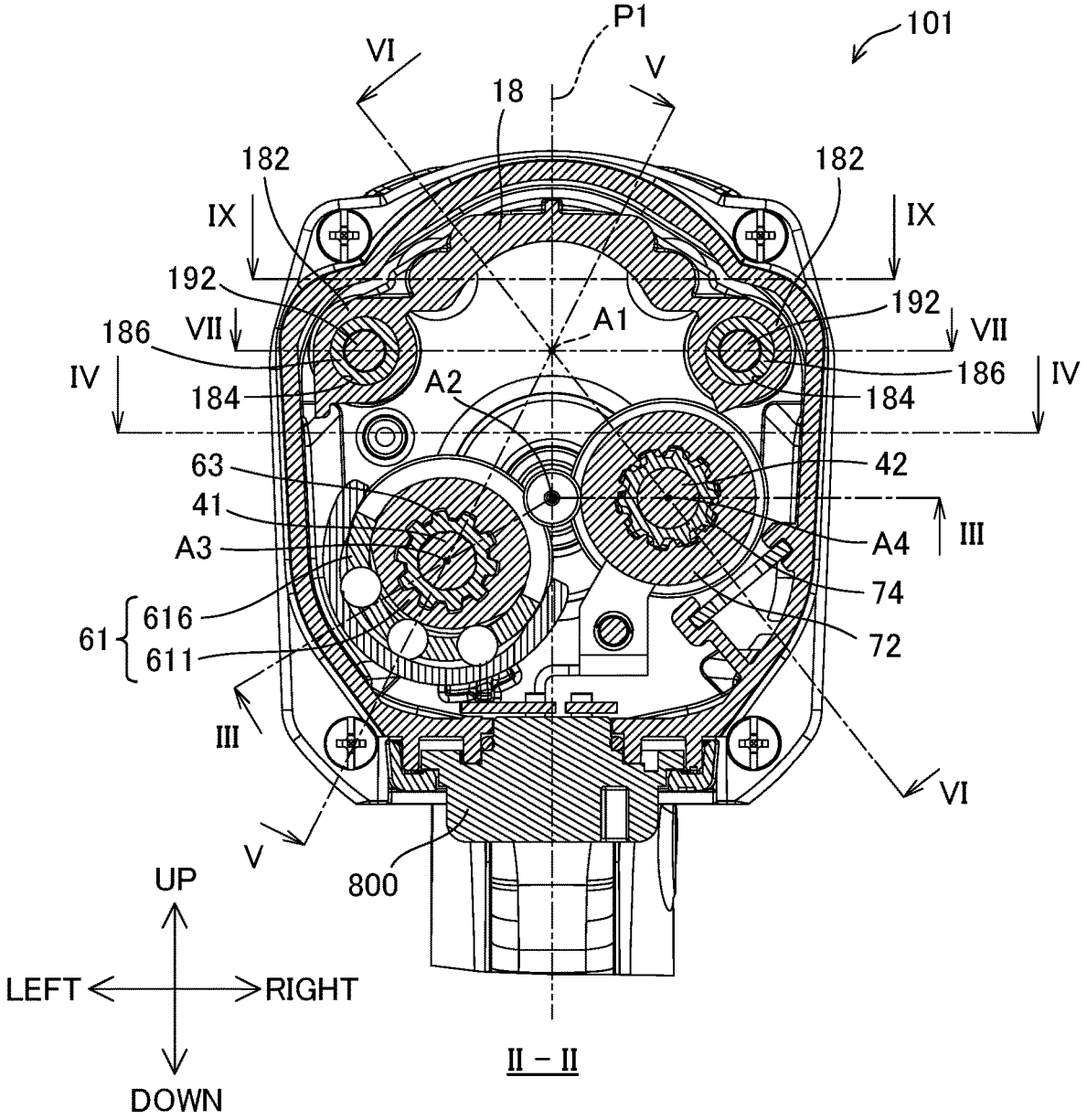
FIG. 2 is a sectional view taken along line II-II in FIG. 1.
Figure 3:
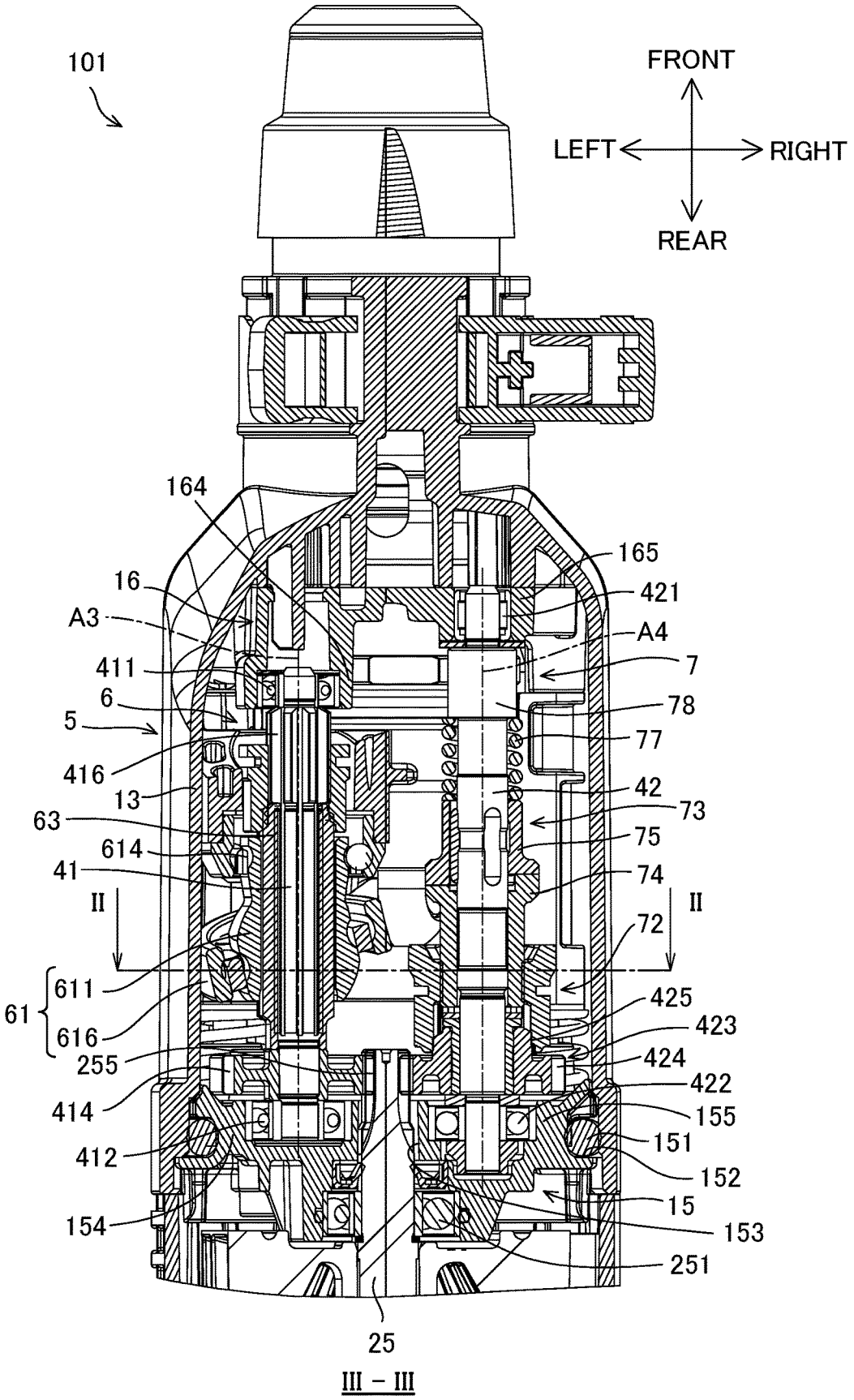
FIG. 3 is a sectional view taken along line III-III in FIG. 2.

Next, power-transmission paths from the motor shaft 25 to the driving mechanism 5 are described. As shown in FIGS. 2 and 3, in this embodiment, the rotary hammer 101 includes two intermediate shafts (i.e. a first intermediate shaft 41 and a second intermediate shaft 42). The driving mechanism 5 is configured to perform the hammering operation using power transmitted from (via) the first intermediate shaft 41 and perform the drilling operation using power transmitted from (via) the second intermediate shaft 42. In other words, the first intermediate shaft 41 is a shaft provided exclusively for (dedicated to) power transmission for hammering operations, and the second intermediate shaft 42 is a shaft provided exclusively for (dedicated to) power transmission for drilling operations.

Both the first intermediate shaft 41 and the second intermediate shaft 42 extend within the front housing 13 in parallel to the driving axis A1 and the rotation axis A2. As shown in FIG. 3, the first intermediate shaft 41 is supported via two bearings 411 and 412 so as to be rotatable around a rotation axis A3 relative to the body housing 10. Similarly, the second intermediate shaft 42 is supported via two bearings 421 and 422 so as to be rotatable around a rotation axis A4 relative to the body housing 10.

The bearing 411 that supports the first intermediate shaft 41 in the front side and the bearing 421 that supports the second intermediate shaft 42 in the front side are supported by a second support 16. More specifically, the bearing 411 is supported by a portion of the second support 16, namely a bearing-support part 164, that is formed into an generally hollow circular cylindrical shape, and the bearing 421 is supported by another portion of the second support 16, namely a bearing-support part 165, that is formed into an generally hollow circular cylindrical shape (see FIGS. 3, 13, and 14). The bearing 412 that supports the first intermediate shaft 41 in the rear side and the bearing 422 that supports the second intermediate shaft 42 in the rear side are supported by the first support 15. More specifically, the bearing 412 is supported by a portion of the first support 15, namely a bearing-support part 154, that is formed into a hollow circular cylindrical shape, and the bearing 422 is supported by another portion of the first support 15, namely a bearing-support part 155, that is formed into a hollow circular cylindrical shape (see FIGS. 3 and 11).

As shown in FIG. 3, the bearing 411 for supporting the first intermediate shaft 41 in the front side and the bearing 421 for supporting the second intermediate shaft 42 in the front side are disposed at positions different from each other in the front-rear direction. This is because the bearings 411 and 421 are arranged at positions that allow the first intermediate shaft 41 and the second intermediate shaft 42 to have minimum lengths, respectively. That is, even though the bearings 411 and 421 are supported by a single (integral) member, namely the second support 16, the positions of the bearings 411 and 421 in the front-rear direction are not constrained by the second support 16. Therefore, the rotary hammer 101 can be prevented from getting longer due to the use of a single member to support both the bearings 411 and 421.

Figure 7:
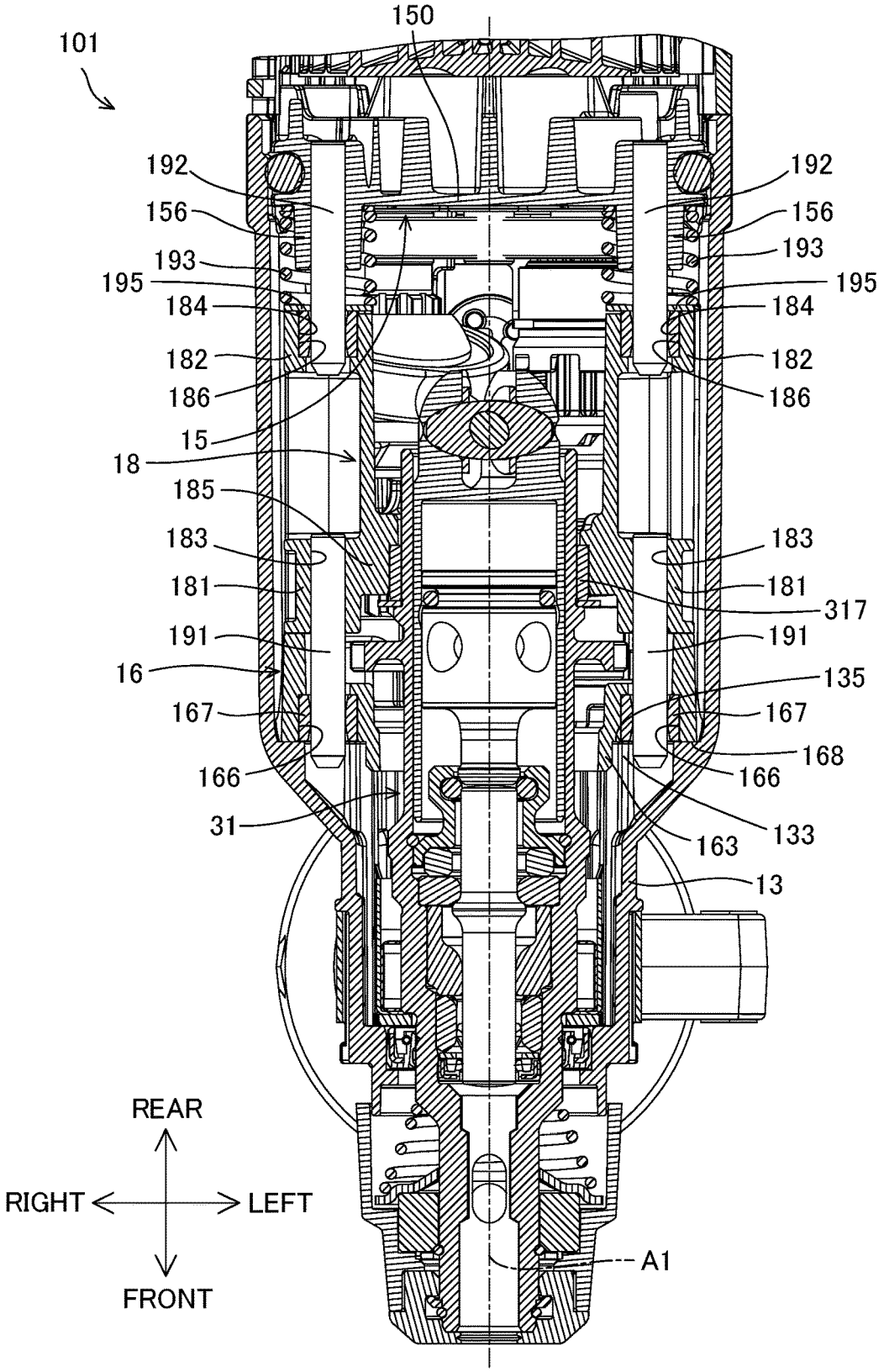
FIG. 7 is a sectional view taken along line VII-VII in FIG. 2, wherein the movable support is located in its foremost position.
Figure 8:
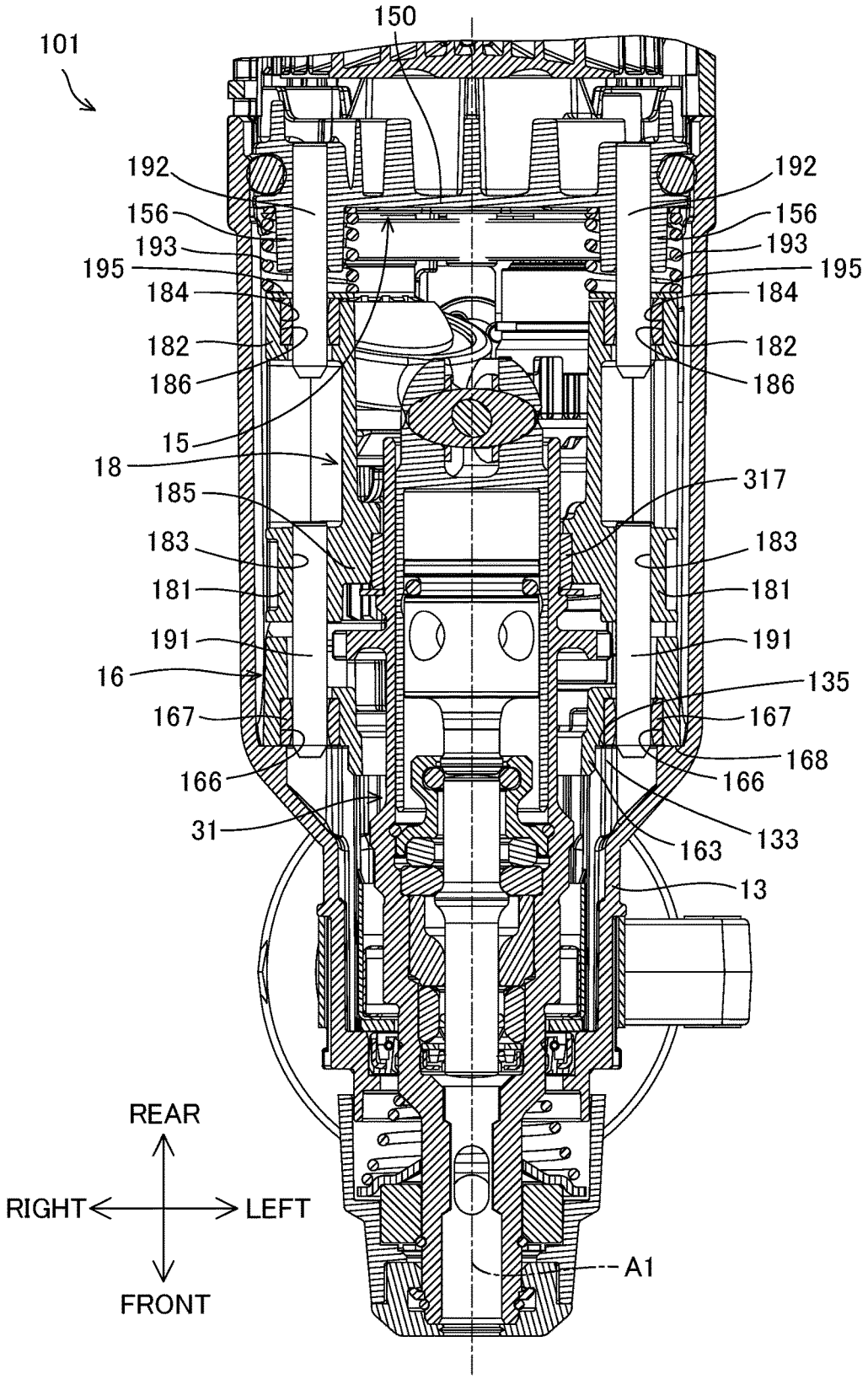
FIG. 8 is a sectional view taken along line VII-VII in FIG. 2, wherein the movable support is located in its rearmost position.
Figure 13:
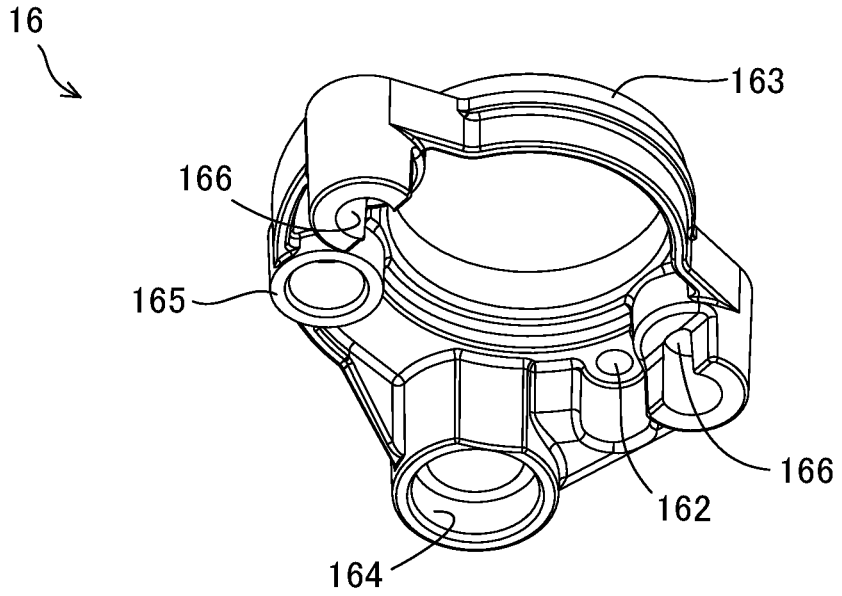
FIG. 13 is a perspective view of a second support.
Figure 14:
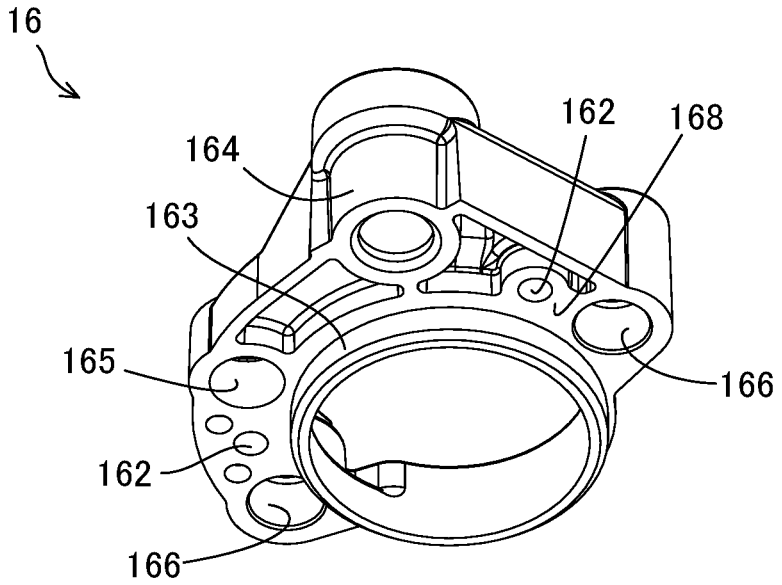
FIG. 14 is a perspective view of the second support.

As shown in FIGS. 1 and 3, the second support 16 is fixed inside the front housing 13. More specifically, as shown in FIGS. 13 and 14, the second support 16 includes a first positioning part 163, an attachment surface 168, and two through holes 162. The first positioning part 163 is a portion having a hollow circular cylindrical shape protruding frontwards. As shown in FIGS. 7 and 8, this first positioning part 163 is disposed so as to circumferentially surround the spindle 31 (in other words, so that the spindle 31 extends through the first positioning part 163 in the front-rear direction). As shown in FIGS. 13 and 14, the attachment surface 168 spreads, at a position radially outward of the first positioning part 163, in the form of a single plane orthogonal to the front-rear direction. The two through holes 162 extend through the second support 16 in the front-rear direction, respectively.

On the other hand, the front housing 13 to which the second support 16 is fixed includes a second positioning part 133 and an attachment surface 135, as shown in FIGS. 7 and 8. The second positioning part 133 is a portion of the inside of the front housing 13 protruding rearward. The second positioning part 133 has a concave portion formed on its radially inward side and is disposed so as to circumferentially surround the spindle 31. A rear end surface of the second positioning part 133 forms the attachment surface 135 orthogonal to the front-rear direction.

As shown in FIGS. 7 and 8, the second support 16 is attached to the front housing 13 so that the first positioning part 163 is fitted with the concave portion of the second positioning part 133 in the front-rear direction. The fitting structure between the concave and convex shapes enables precise and easy positioning of the second support 16 relative to the front housing 13 in a direction orthogonal to the front-rear direction in the process of assembling the rotary hammer 101. In an alternative embodiment, the first positioning part 163 and the second positioning part 133 may have reversed shapes. That is, the first positioning part 163 may be a concave portion formed in the second support 16; whereas the second positioning part 133 may be a convex portion protruding from the front housing 13 and may be fitted with the concave portion of the second support 16.

As shown in FIGS. 7 and 8, the attachment surface 168 of the second support 16 abuts the attachment surface 135 of the front housing 13 in the front-rear direction when the first positioning part 163 is fitted with the second positioning part 133 in the front-rear direction. Each of the attachment surfaces 168 and 135 is a plane orthogonal to the front-rear direction. This enables precise and easy positioning of the second support 16 relative to the front housing 13 in the front-rear direction in the process of assembling the rotary hammer 101.

Figure 4:
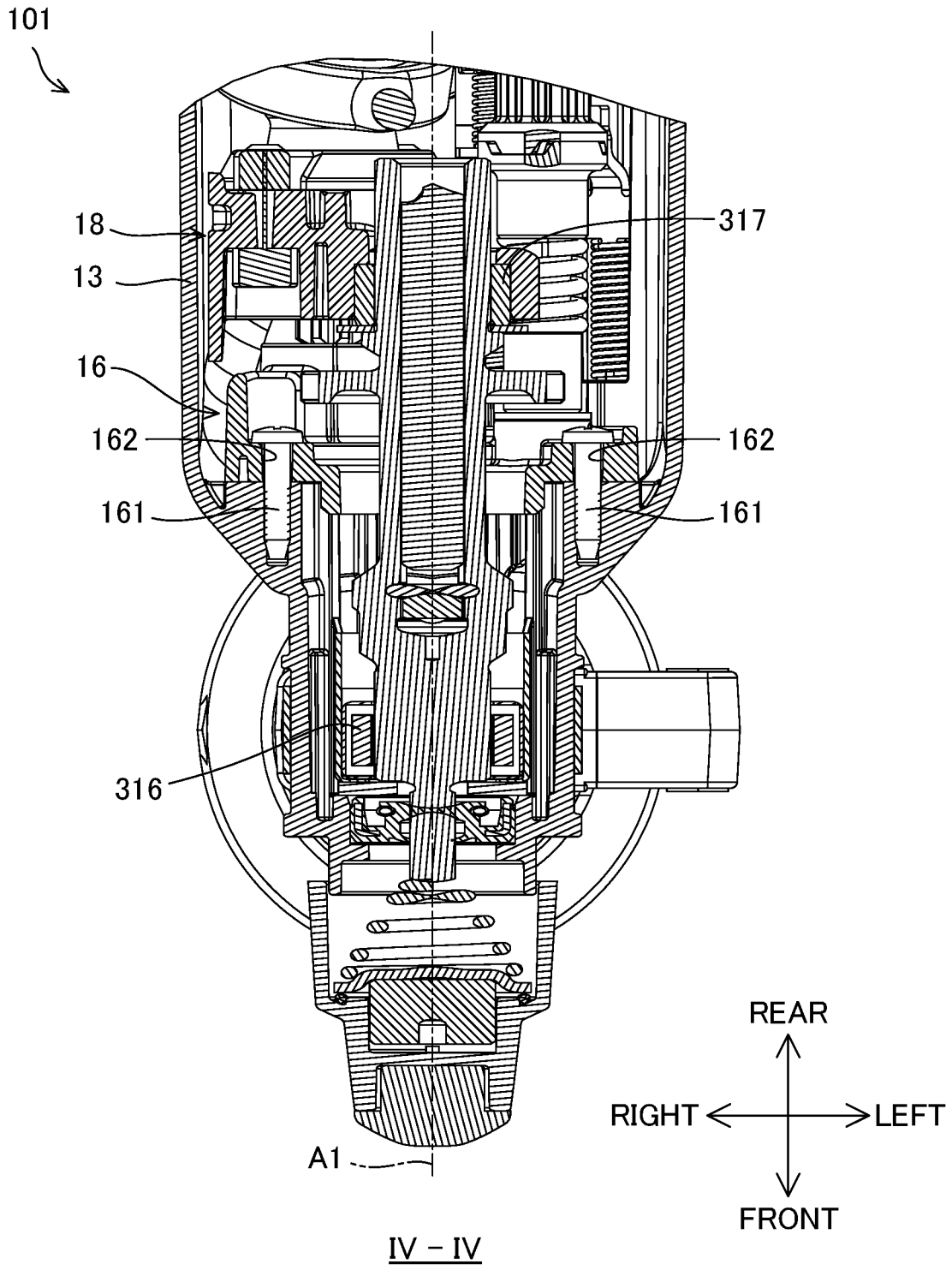
FIG. 4 is a sectional view taken along line IV-IV in FIG. 2.

The second support 16 thus positioned relative to the front housing 13 is then fixed to the front housing 13 by screws 161 respectively inserted into the through holes 162 of the second support 16, as shown in FIG. 4.

To provide a required level of positional accuracy for the bearings 411 and 421, the second support 16 of such a structure is formed of metal. In this embodiment, the second support 16 is formed of aluminum-based metal. The rotary hammer 101 can thus have a reduced weight.

As shown in FIG. 3, a first driven gear 414 is fixed to a rear end portion of the first intermediate shaft 41 adjacent to and in front of the bearing 412. The first driven gear 414 meshes with a pinion gear 255.

A gear member 423 having a second driven gear 424 is disposed adjacent to and in front of the bearing 422 on a rear end portion of the second intermediate shaft 42. The second driven gear 424 meshes with the pinion gear 255. The gear member 423 has a hollow circular cylindrical shape and is disposed on an outer peripheral side of the second intermediate shaft 42 (specifically, of a drive-side member 74 which will be described later). A spline part 425 is provided on an outer periphery of a hollow circular cylindrical front end portion of the gear member 423. The spline part 425 includes a plurality of splines (external teeth) extending in a direction of the rotation axis A4 (i.e. front-rear direction). Rotation of the second driven gear 424 (the gear member 423) is transmitted to the second intermediate shaft 42 via a second transmitting member 72 and a torque limiter 73. Details of the mechanism will be described in detail later.

As described above, in this embodiment, two power-transmission paths branch from the motor shaft 25 and respectively serve as a power-transmission path dedicated to hammering operations and another power-transmission path dedicated to drilling operations.

The spindle 31 is now described. The spindle 31 is a final output shaft of the rotary hammer 101. As shown in FIG. 1, the spindle 31 is arranged within the front housing 13 along the driving axis A1 and is supported to be rotatable around the driving axis A1 relative to the body housing 10. The spindle 31 is configured as an elongate, stepped hollow circular cylindrical member.

A front half of the spindle 31 forms the tool holder 32 to or in which the tool accessory 91 can be removably attached. The tool accessory 91 is inserted into a bit-insertion hole 330 formed in a front end portion of the tool holder 32 such that a longitudinal axis of the tool accessory 91 coincides with the driving axis A1. The tool accessory 91 is held in the insertion hole 330 so as to be movable relative to the tool holder 32 in the axial direction while its rotation around the axis is restricted (blocked). A rear half of the spindle 31 forms a cylinder 33 configured to slidably hold a piston 65 described below. The spindle 31 is supported by a bearing 316 held within the barrel part 131 and a bearing 317 held by a movable support 18 described below.

Figure 5:
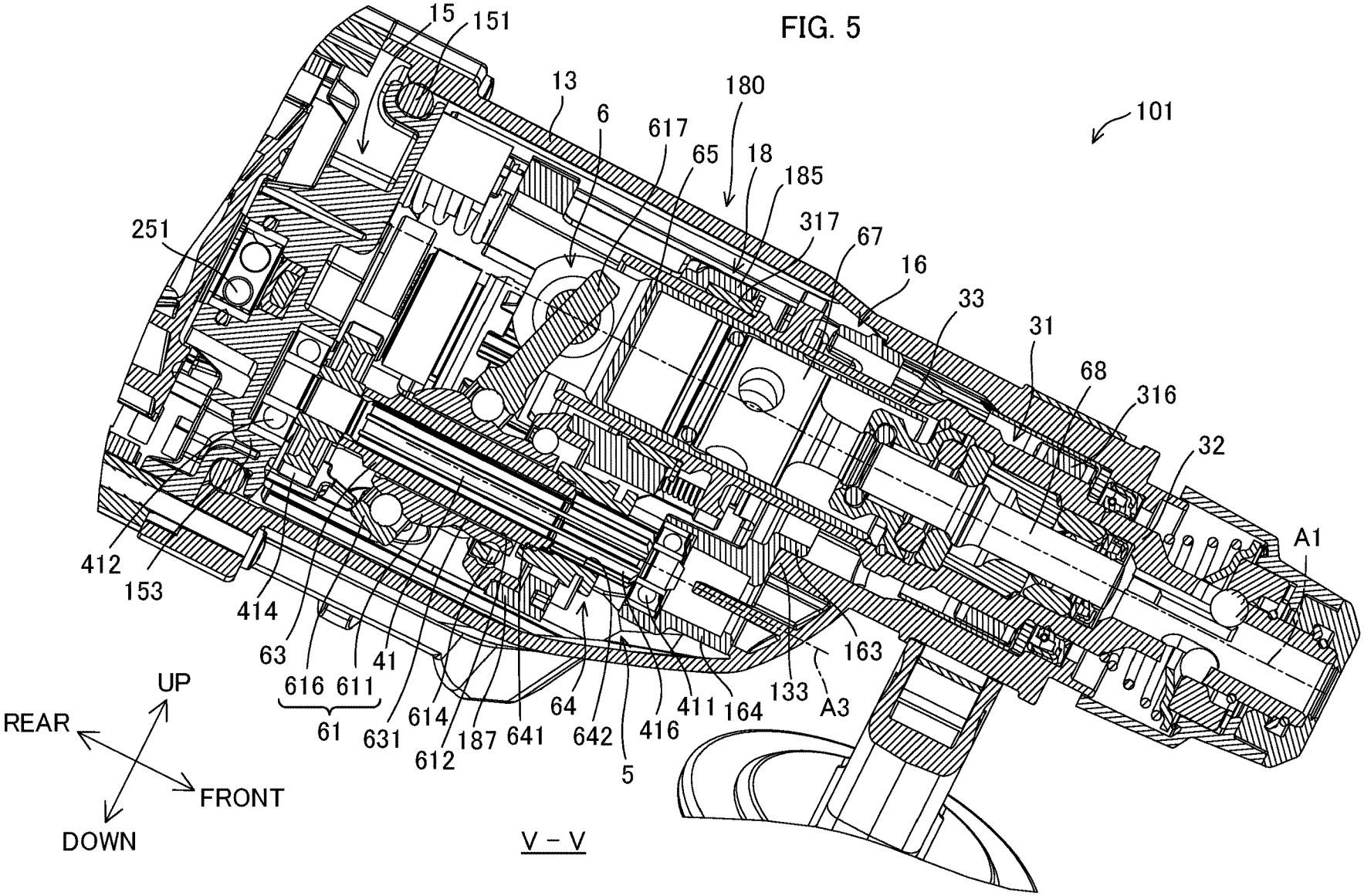
FIG. 5 is a sectional view taken along line V-V in FIG. 2.
Figure 6:
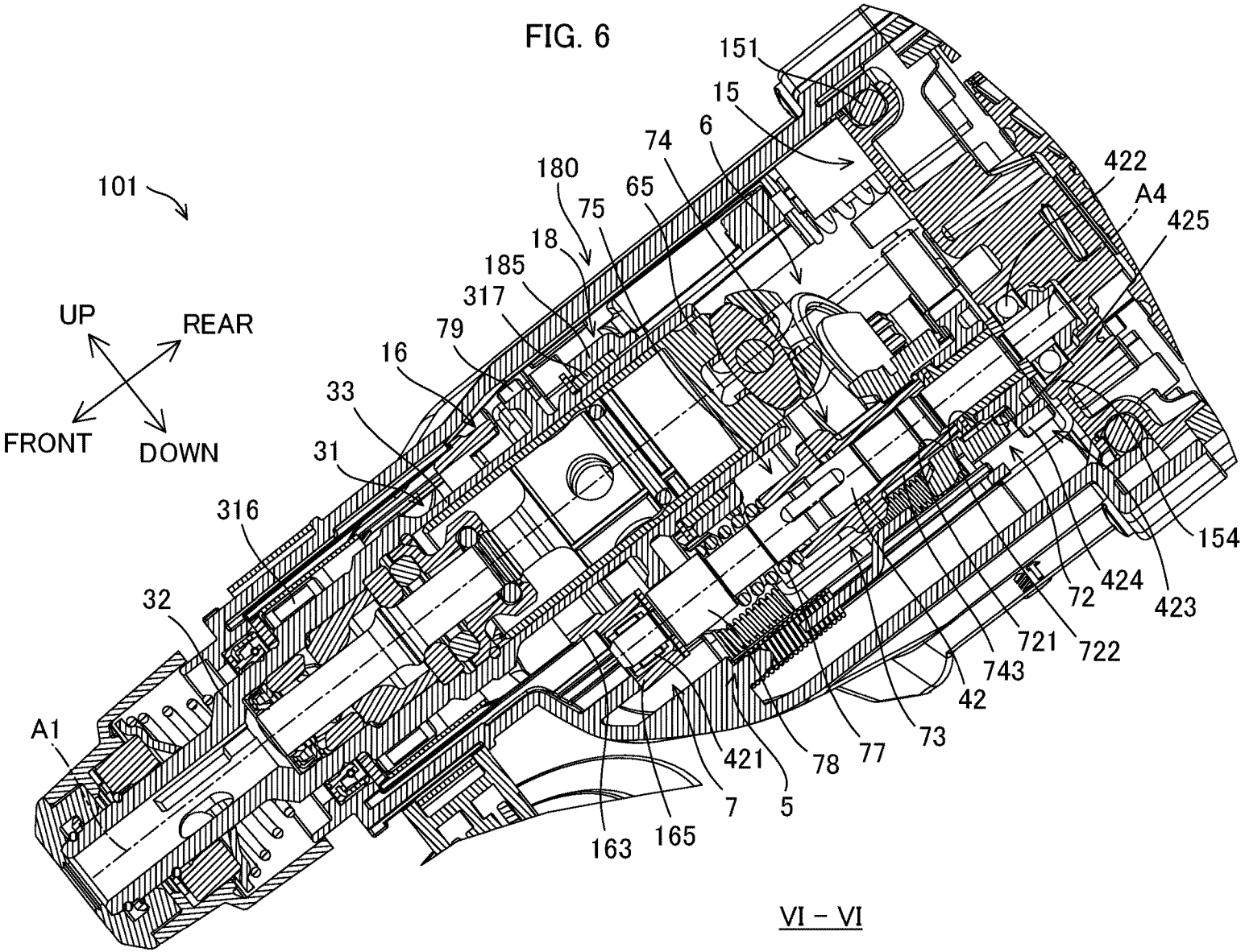
FIG. 6 is a sectional view taken along line VI-VI in FIG. 2.

The driving mechanism 5 is now described. As shown in FIGS. 3, 5, and 6, in this embodiment, the driving mechanism 5 includes a striking mechanism 6 and a rotation-transmitting mechanism 7. The striking mechanism 6 is a mechanism for performing hammering operations, and is configured to convert rotation of the first intermediate shaft 41 into linear motion and linearly reciprocally drive the tool accessory 91 along the driving axis A1. The rotation-transmitting mechanism 7 is a mechanism for performing drilling operations, and is configured to transmit rotation of the second intermediate shaft 42 to the spindle 31 and rotationally drive the tool accessory 91 around the driving axis A1. The structures of the striking mechanism 6 and the rotation-transmitting mechanism 7 are now described in detail in this order.

In this embodiment, as shown in FIGS. 3 and 5, the striking mechanism 6 includes a motion-converting member 61, a piston 65, a striker 67, and an impact bolt 68.

The motion-converting member 61 is disposed around the first intermediate shaft 41, and is configured to convert rotation of the first intermediate shaft 41 into linear reciprocating motion and transmit it to the piston 65. More specifically, the motion-converting member 61 includes a rotary body 611 and an oscillating member 616. The rotary body 611 is supported by a bearing 614 so as to be rotatable around the rotation axis A3 relative to the body housing 10. The oscillating member 616 is rotatably mounted on an outer periphery of the rotary body 611, and is configured to oscillate (pivot or rock back and forth) in an extension direction of the rotation axis A3 (i.e. front-rear direction) while the rotary body 611 is rotating. The oscillating member 616 has an arm 617 extending upward away from the rotary body 611.

The piston 65 is a bottomed hollow circular cylindrical member, and is disposed within the cylinder 33 of the spindle 31 so as to be slidable along the driving axis A1. The piston 65 is connected to the arm 617 of the oscillating member 616 via a connecting pin and reciprocally moves in the front-rear direction while the oscillating member 616 is oscillating (pivoting or rocking back-and-forth in the front-rear direction).

The striker 67 is a striking element for applying a striking force to the tool accessory 91. The striker 67 is disposed within the piston 65 so as to be slidable along the driving axis A1. An internal space of the piston 65 in the rear of the striker 67 is defined as an air chamber that serves as an air spring. The impact bolt 68 is an intermediate element for transmitting kinetic energy of the striker 67 to the tool accessory 91. The impact bolt 68 is disposed within the tool holder 32 in front of the striker 67 so as to be movable along the driving axis A1.

When the piston 65 is moved in the front-rear direction along with oscillating movement of the oscillating member 616, the air pressure within the air chamber fluctuates and the striker 67 slides in the front-rear direction within the piston 65 by the action of the air spring. More specifically, when the piston 65 is moved forward, the air within the air chamber is compressed and its internal pressure increases. Thus, the striker 67 is pushed forward at high speed by the action of the air spring and strikes the impact bolt 68. The impact bolt 68 transmits the kinetic energy of the striker 67 to the tool accessory 91. Thus, the tool accessory 91 is linearly driven along the driving axis A1. On the other hand, when the piston 65 is moved rearward, the air within the air chamber expands and its internal pressure decreases so that the striker 67 is retracted (moved) rearward. The tool accessory 91 moves rearward along with the impact bolt 68 by being pressed against a workpiece. In this manner, the striking mechanism 6 repetitively performs the hammering operation.

In this embodiment, rotation of the first intermediate shaft 41 is transmitted to the motion-converting member 61 (specifically, the rotary body 611) via a first transmitting member 64 and an intervening member 63. The intervening member 63 and the first transmitting member 64 are now described in this order.

As shown in FIG. 5, the intervening member 63 is a hollow circular cylindrical member coaxially disposed around the first intermediate shaft 41, between the first intermediate shaft 41 and the motion-converting member 61 (specifically, the rotary body 611). The intervening member 63 is immovable in the front-rear direction relative to the first intermediate shaft 41 while being rotatable around the rotation axis A3 relative to the first intermediate shaft 41.

More specifically, a front end portion (a portion adjacent to the rear side of the front bearing 411) of the first intermediate shaft 41 is configured as a maximum-diameter part having a maximum outer diameter. A spline part 416 is provided on an outer periphery of the maximum-diameter part. The spline part 416 includes a plurality of splines (external teeth) extending in the rotation axis A3 direction (i.e. front-rear direction). The intervening member 63 is held to be immovable in the front-rear direction between the spline part 416 and the first driven gear 414 fixed to the rear end portion of the first intermediate shaft 41.

A spline part 631 is provided on an outer periphery of the intervening member 63 and extends generally over the entire length of the intervening member 63. The spline part 631 includes a plurality of splines (external teeth) extending in the rotation axis A3 direction (i.e. front-rear direction).

On the other hand, a spline part 612 is formed on an inner periphery of the rotary body 611. The spline part 612 includes splines (internal teeth) to be engaged (meshed) with the spline part 631. The intervening member 63 is always spline-engaged with the rotary body 611, and is held by the rotary body 611. Such a structure allows the rotary body 611 to be movable in the rotation axis A3 direction (i.e. front-rear direction) relative to the intervening member 63 and the first intermediate shaft 41 as well as to be rotatable together with the intervening member 63.

The first transmitting member 64 is disposed on the first intermediate shaft 41, and is configured to be rotatable together with the first intermediate shaft 41 as well as to be movable in the rotation axis A3 direction (i.e. front-rear direction) relative to the first intermediate shaft 41 and the intervening member 63.

More specifically, the first transmitting member 64 is a generally hollow circular cylindrical member disposed around the first intermediate shaft 41. A first spline part 641 and a second spline part 642 are provided on an inner periphery of the first transmitting member 64.

The first spline part 641 is provided on a rear end portion of the first transmitting member 64. The first spline part 641 includes a plurality of splines (internal teeth) configured to be engaged (meshed) with the spline part 631 of the intervening member 63. As described above, the spline part 631 of the intervening member 63 is also engaged (meshed) with the spline part 612 of the rotary body 611. The second spline part 642 is provided on a front half of the first transmitting member 64. The second spline part 642 includes a plurality of splines (internal teeth) configured to be always engaged (meshed) with the spline part 416 of the first intermediate shaft 41.

With such a structure, when the first spline part 641 of the first transmitting member 64 that is movable in the front-rear direction is placed in a position (hereinafter referred to as an engagement position) to be engaged with the spline part 631 of the intervening member 63, as shown in FIG. 5, the first transmitting member 64 is rotatable together with the intervening member 63, that is, first transmitting member 64 is capable of transmitting power (rotational force) from the first intermediate shaft 41 to the intervening member 63.

On the other hand, when the first spline part 641 of the first transmitting member 64 moveable in the front-rear direction is placed in a position (not shown, hereinafter referred to as a spaced apart position) to be spaced apart from (incapable of being engaged with) the spline part 631, the first transmitting member 64 disables (interrupts, disconnects) power transmission from the first intermediate shaft 41 to the intervening member 63.

As shown in FIG. 6, in this embodiment, the rotation-transmitting mechanism 7 includes a driving gear 78 and a driven gear 79. The driving gear 78 is fixed to a front end portion (a portion adjacent to the rear side of the front bearing 421) of the second intermediate shaft 42. The driven gear 79 is fixed to an outer periphery of the cylinder 33 of the spindle 31 and meshes with the driving gear 78. The driving gear 78 and the driven gear 79 form a speed-reducing (torque-increasing) gear mechanism. The spindle 31 is rotated together with the driven gear 79 in response to rotation of the driving gear 78 together with the second intermediate shaft 42. The drilling operation is thus performed in which the tool accessory 91 held by the tool holder 32 is rotationally driven around the driving axis A1.

As described above, in this embodiment, rotation of the second driven gear 42 caused by rotation of the motor shaft 25 is transmitted to the second intermediate shaft 42 via the second transmitting member 72 and the torque limiter 73. The torque limiter 73 and the second transmitting member 72 are now described in this order.

As shown in FIG. 6, the torque limiter 73 includes a drive-side member 74, a driven-side member 75, and a biasing spring 77. The drive-side member 74 is a hollow circular cylindrical member and is supported by a rear half of the second intermediate shaft 42 so as to be rotatable relative to the second intermediate shaft 42. The driven-side member 75 is a hollow circular cylindrical member and is disposed around the second intermediate shaft 42 in the front side of the drive-side member 74. The driven-side member 75 is configured to be rotatable together with the second intermediate shaft 42 as well as to be movable in the rotation axis A4 direction (i.e. front-rear direction) relative to the second intermediate shaft 42. The biasing spring 77 always biases the driven-side member 75 in a direction toward the drive-side member 74. Therefore, in normal times, a front end portion of the drive-side member 74 and a rear end portion of the driven-side member 75 are engaged with each other. This allows torque to be transmitted from the drive-side member 74 to the driven-side member 75 and in turn enables rotation of the second intermediate shaft 42.

When the second intermediate shaft 42 is rotating and a load exceeding the threshold is applied to the second intermediate shaft 42 via the tool holder 32 (the spindle 31), the driven-side member 75 moves in a direction away from the drive-side member 74 (i.e. forward) against the biasing force of the biasing spring 77 and thus becomes disengaged from the drive-side member 74. This disconnects transmission of torque from the drive-side member 74 to the driven-side member 75 and interrupts rotation of the second intermediate shaft 42.

The drive-side member 74 includes a spline part 743. The spline part 743 is provided on an outer periphery of the drive-side member 74 and includes a plurality of splines (external teeth) extending in the rotation axis A4 direction (i.e. front-rear direction).

As shown in FIG. 6, the second transmitting member 72 is disposed around the second intermediate shaft 42, and is configured to be rotatable together with the drive-side member 74 of the torque limiter 73 as well as to be movable in the rotation axis A4 direction (i.e. front-rear direction) relative to the drive-side member 74 and the gear member 423.

More specifically, the second transmitting member 72 is a generally hollow circular cylindrical member disposed around the drive-side member 74. A first spline part 721 and a second spline part 722 are provided on an inner periphery of the second transmitting member 72. The first spline part 721 is provided on a front half of the second transmitting member 72. The first spline part 721 includes a plurality of splines (internal teeth) that are always engaged (meshed) with the spline part 743 of the drive-side member 74. The second spline part 722 is provided on a rear end portion of the second transmitting member 72 and has a larger inner diameter than the first spline part 721. The second spline part 722 includes a plurality of splines (internal teeth) configured to be engaged (meshed) with the spline part 425 of the gear member 423.

With such a structure, when the second spline part 722 of the second transmitting member 72 movable in the front-rear direction is placed in a position (hereinafter referred to as an engagement position) to be engaged with the spline part 425 of the gear member 423 in the front-rear direction, as shown in FIG. 6, the second transmitting member 72 is rotatable together with the gear member 423. This allows the drive-side member 74, which is spline-engaged with the second transmitting member 72, and thus the second intermediate member 42, to which torque is transmitted via the driven-side member 75, also to be rotatable together with the gear member 423.

On the other hand, when the second spline part 722 movable in the front-rear direction is placed in a position (not shown, hereinafter referred to as a spaced apart position) to be spaced apart (separated) from (incapable of being engaged with) the spline part 425, the second transmitting member 72 disables (interrupts, disconnects) power transmission from the gear member 423 to the drive-side member 74 and thus to the second intermediate shaft 42.

As described above, in this embodiment, the first transmitting member 64 and the intervening member 63 function as a first clutch mechanism that transmits power for the hammering operation or interrupts this power transmission; whereas the second transmitting member 72 and the gear member 423 function as a second clutch mechanism that transmits power for the drilling operation (tool holder rotation) or interrupts this power transmission. Each of the first clutch mechanism and the second clutch mechanism is switched between a power-transmission state and a power-interruption state in response to user manipulation of a mode-changing dial 800 (see FIG. 1). More specifically, an intermediate member (not shown) configured to operate in response to the mode-changing dial 800 changes the position of the first transmitting member 64 and/or the position of the second transmitting member 72 according to the dial position of the mode-changing dial 800 and thereby achieves mode-switching of the first clutch mechanism and the second clutch mechanism.

In this embodiment, the rotary hammer 101 is switched between three action modes, namely a hammer-drill mode (rotation with hammering), a hammer mode (hammering only), and a drill mode (rotation only), in response to the manipulation of the mode-changing dial 800. The hammer-drill mode is a mode in which the striking mechanism 6 and the rotation-transmitting mechanism 7 are both driven, so that the hammering operation and the drilling operation are both performed, i.e. the tool accessory 91 is simultaneously rotated and axially hammered. The hammer mode is a mode in which power transmission for the drilling operation is interrupted by the second clutch mechanism and only the striking mechanism 6 is driven, so that only the hammering operation is performed, i.e. the tool accessory 91 is only hammered (without rotation). The drill mode is a mode in which power transmission for the hammering operation is interrupted by the first clutch mechanism and only the rotation-transmitting mechanism 7 is driven, so that only the drilling operation is performed, i.e. the tool accessory 91 is only rotated (without hammering).

As described above, the rotary hammer 101 of this embodiment includes two separate (discrete) intermediate shafts (i.e. the first intermediate shaft 41 and the second intermediate shaft 42) that are configured to extend in parallel to the driving axis A1 and transmit power for the hammering operation and the drilling operation, respectively. Therefore, the first intermediate shaft 41 and the second intermediate shaft 42 can be made shorter compared to a case in which one common intermediate shaft is used for power transmission for both the hammering operation and the drilling operation. Thus, the overall length of the rotary hammer 101 can be reduced in the driving-axis direction.

Further, the first intermediate shaft 41 and the second intermediate shaft 42 are respectively dedicated to power transmission for the hammering operation and power transmission for the drilling operation. This optimizes power transmission via the first intermediate shaft 41 and power transmission via the second intermediate shaft 42, respectively.

In this embodiment, the rotary hammer 101 is configured to reduces vibration (in particular, vibration in the front-rear direction) to be transmitted to the body housing 10 and the handle 17 due to driving of the driving mechanism 5. The vibration-isolating structure of the rotary hammer 101 is now described.

In this embodiment, as shown in FIG. 1, the spindle 31 and the striking mechanism 6 (specifically, the motion-converting member 61, the piston 65, the striker 67, and the impact bolt 68) are disposed within the body housing 10 so as to be movable in the driving-axis direction (i.e. front-rear direction) relative to the body housing 10. More specifically, a movable support 18 is disposed within the body housing 10 in a state in which the movable support 18 is biased forward relative to the body housing 10, and is movable in the front-rear direction relative to the body housing 10. The spindle 31 and the striking mechanism 6 are supported by the movable support 18 and are thus movable together with the movable support 18 relative to the body housing 10.

Figure 12:
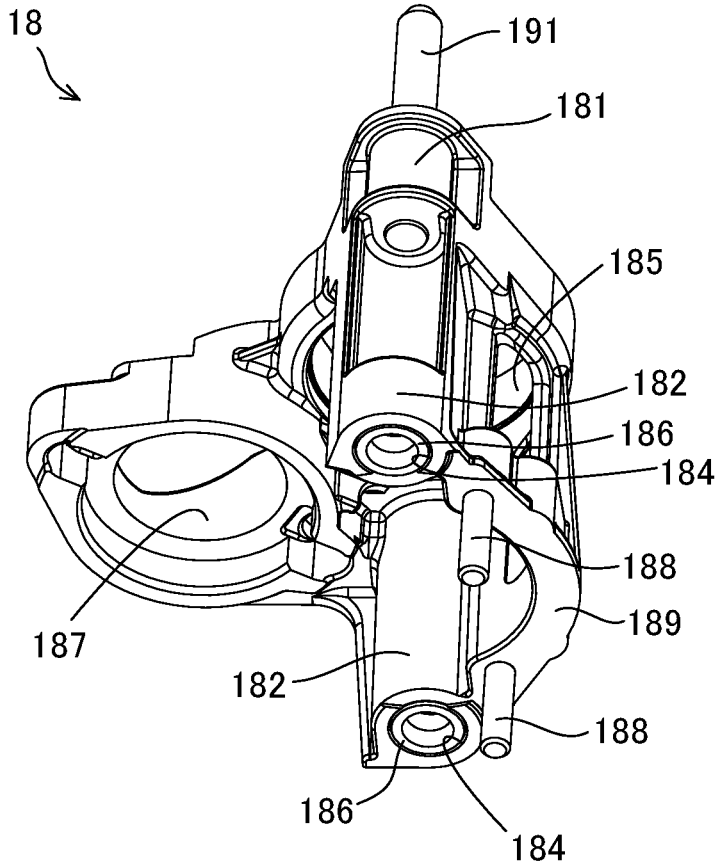
FIG. 12 is a perspective view of the movable support.

As shown in FIGS. 5, 6, and 12, the movable support 18 includes a spindle-support part 185 and a rotary-body-support part 187. In this embodiment, the movable support 18 is formed as a single (integral) metal member.

The spindle-support part 185 has a generally circular cylindrical shape and is configured as a part for supporting the spindle 31. As shown in FIGS. 5 and 6, the bearing 317 is held inside the spindle-support part 185. The spindle-support part 185 supports a rear portion of the cylinder 33 via the bearing 317 so that the cylinder 33 is rotatable around the driving axis A1. As described above, the spindle 31 is supported by the two bearings 316 and 317 so as to be rotatable around the driving axis A1 relative to the body housing 10. The other bearing 316 is held within the barrel part 131 and supports a rear portion of the tool holder 32 so that the tool holder 32 is rotatable around the driving axis A1 and movable in the front-rear direction.

The rotary-body-support part 187 is a generally hollow circular cylindrical portion and is located in the lower right side of the spindle-support part 185. As shown in FIG. 5, the bearing 614 is fixed to the rotary-body-support part 187 by screws. The rotary-body-support part 187 supports the rotary body 611 via the bearing 614 so that the rotary body 611 is rotatable around the rotation axis A3.

As described above, the spindle 31 and the rotary body 611 are supported by the movable support 18. Therefore, the oscillating member 616, which is mounted on the rotary body 611, and the piston 65, the striker 67, and the impact bolt 68, which are disposed within the spindle 31, are also supported by the movable support 18. Thus, the movable support 18, the spindle 31, and the striking mechanism 6 form a movable unit 180 as an assembly that is integrally movable relative to the body housing 10 (or in other words, the motor 2) in the front-rear direction.

Movement of the movable unit 180 including the movable support 18 in the front-rear direction is slidably guided by a pair of first guide shafts 191 and a pair of second guide shafts 192. As shown in FIGS. 7 and 8, the pair of first guide shafts 191 and the pair of second guide shafts 192 coaxially extend in the axial direction (i.e. front-rear direction).

More specifically, as shown in FIGS. 7, 8, and 12, the movable support 18 includes a pair of hollow circular cylindrical parts 181 radially outward of the spindle-support part 185 (only one hollow circular cylindrical part 18 is visible in FIG. 12). As shown in FIGS. 7 and 8, the pair of hollow circular cylindrical part 181 are arranged to be bilaterally symmetrical. In other words, the hollow circular cylindrical parts 181 are symmetrically arranged respectively on the right and left sides of an imaginary plane P1 (see FIG. 2) including the driving axis A1 and the rotation axis A2. A hole 183 is formed through each hollow circular cylindrical part 181 in the front-rear direction. Approximately a rear half of each first guide shaft 191 is press fitted into the corresponding hole 183, while approximately a front half of each first guide shaft 191 extends frontward from the movable support 18. Therefore, the first guide shafts 191 are fixed to the movable support 18 and are configured to move in the front-rear direction together with the movable support 18.

The pair of first guide shafts 191 are respectively received in a pair of holes 166 (see FIGS. 13 and 14) formed in the second support 16. More specifically, as shown in FIGS. 7 and 8, each hole 166 extends through the second support 16 in the front-rear direction. The inner diameter of each hole 166 is larger in its front portion than in its rear portion. Therefore, the second support 16 has stepwise inner surfaces each forming the corresponding hole 166. The second support 16 includes a sleeve 167 of a hollow circular cylindrical shape within each hole 166. The sleeve 167 is press fitted into the front portion of the hole 166 having the larger-diameter so that a rear end of the sleeve 167 abuts the step on the inner surface of the hole 166. Each first guide shaft 191 is always received within the corresponding sleeve 167 so that the first guide shaft 191 slides on an inner peripheral surface of the sleeve 167 while the movable support 18 is moving in the front-rear direction. Each first guide shaft 191 only slides on the corresponding sleeve 167 but not on the other parts of the second support 16. In this embodiment, a front end portion of each sleeve 167 abuts the front housing 13. Therefore, the sleeve 167 is prevented from coming out of the hole 166 even if the first guide shaft 191 slides on the inner peripheral surface of the sleeve 167. In this embodiment, the sleeve 167 is formed of iron-based metal. Meanwhile, the remaining parts of the second support 16 are formed of aluminum-based metal, as described above. Therefore, the second support 16 including the sleeves 167 can have sufficient strength to withstand sliding movement relative to the first guide shafts 191 and can also have a reduced weight as a whole.

Figure 11:
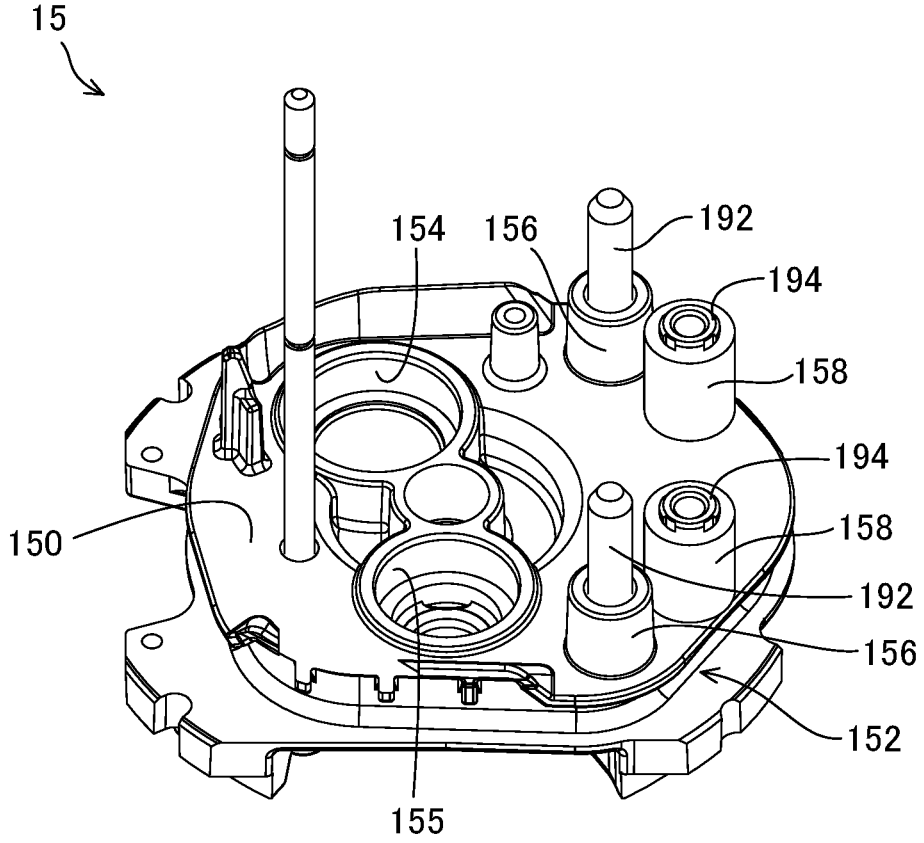
FIG. 11 is a perspective view of a first support.

The pair of second guide shafts 192 are located more rearward than the pair of first guide shafts 191 and are held by the first support 15. More specifically, as shown in FIGS. 7, 8, and 11, the first support 15 includes a pair of shaft-support parts 156. Each shaft-support part 156 has a hollow circular cylindrical shape and extends frontward from a plate-like base 150 that is orthogonal to the front-rear direction. Approximately a rear half of each second guide shaft 192 is press fitted into the corresponding shaft-support part 156. Therefore, the pair of second guide shafts 192 are immovable relative to the first support 15 and thus to the body housing 10. Approximately a front half of each second guide shaft 192 extends frontward from the first support 15.

As shown in FIGS. 7, 8, and 12, the movable support 18 includes a pair of hollow circular cylindrical parts 182 coaxially with the pair of cylindrical parts 181. A hole 184 is formed through each hollow cylindrical part 182 in the front-rear direction. The inner diameter of each hole 184 is larger in its rear portion than in its front portion. Therefore, each hollow cylindrical part 182 has a stepwise inner surface forming the corresponding hole 184. The movable support 18 includes a sleeve 186 of a hollow circular cylindrical shape within each hole 184. The sleeve 186 is press fitted into the larger-diameter rear portion of the corresponding hole 184 so that a front end of the sleeve 186 abuts the step on the inner surface of the hole 184. A front end portion of each second guide shaft 192 is always received within the corresponding sleeve 186 so that an inner peripheral surface of the sleeve 186 slides on the second guide shaft 192 while the movable support 18 is moving in the front-rear direction. Each second guide shaft 192 only slides on the corresponding sleeve 186 but not on the other parts of the movable support 18. In this embodiment, each sleeve 186 is formed of iron-based metal. Meanwhile, the remaining parts of the movable support 18 are formed of aluminum-based metal, as described above. Therefore, the movable support 18 including the sleeves 186 can have sufficient strength to withstand sliding movement relative to the second guide shafts 192 and can also have a reduced weight as a whole. In this embodiment, both the first guide shafts 191 and the second guide shafts 192 are formed of iron-based metal.

The first guide shafts 191 and the second guide shafts 192, which are spaced apart from each other in the front-rear direction, are used to guide movement of the movable support 18 in the front-rear direction. Therefore, the distance over which the guide shafts extend as a whole can be shortened compared to a case in which a single guide shaft extends from where the first guide shaft 191 is to where the second guide shaft 192 is. The rotary hammer 101 can thus have a reduced weight. Moreover, since the guide shafts are respectively placed on both sides of the movable support 18 in the front-rear direction, the movable support 18 can be guided satisfactorily irrespective of the reduced weight.

A pair of biasing springs 193 are disposed in the rear side of the movable support 18. Each spring 193 is a compression coil spring and is disposed in a compressed state between the first support 15 and the movable support 18. More specifically, each biasing spring 193 is disposed around the corresponding one of the pair of second guide shafts 192. A rear end of each biasing spring 193 abuts a washer disposed on the base 150 of the first support 15. Each biasing spring 193 is fitted around the shaft-support part 156. The biasing spring 193 is thus restricted from moving on a plane orthogonal to the front-rear direction. A front end of the each biasing spring 193 abuts a washer 195 disposed between the biasing spring 193 and the movable support 18.

The sleeve 186 disposed within the hole 184 of the hollow circular cylindrical part 182 is always biased forward by the biasing spring 193 via the washer 195. This allows the sleeve 186 to move together with the movable support 18 whenever the movable support 18 moves frontward. That is, the sleeve 186 can be prevented from being left behind and off the hole 184 when the movable support 18 is moving frontward.

With such a structure, the pair of biasing springs 193 always bias the movable support 18 (the movable unit 180) frontward. Therefore, when no rearward external force is being applied to the movable support 18, the movable support 18 is held in (biased to) its foremost position (initial position) where the movable support 18 abuts the second support 16, as shown in FIG. 7. An elastic member may be attached on a rear surface of the second support 16 in order to prevent direct abutment (to dampen the force of collision) between the second support 16 and the movable support 18.

On the other hand, when a rearward external force is being applied to the movable support 18, the movable support 18 can move to its rearmost position shown in FIG. 8. Structures for defining this rearmost position are described below.

Figure 9:
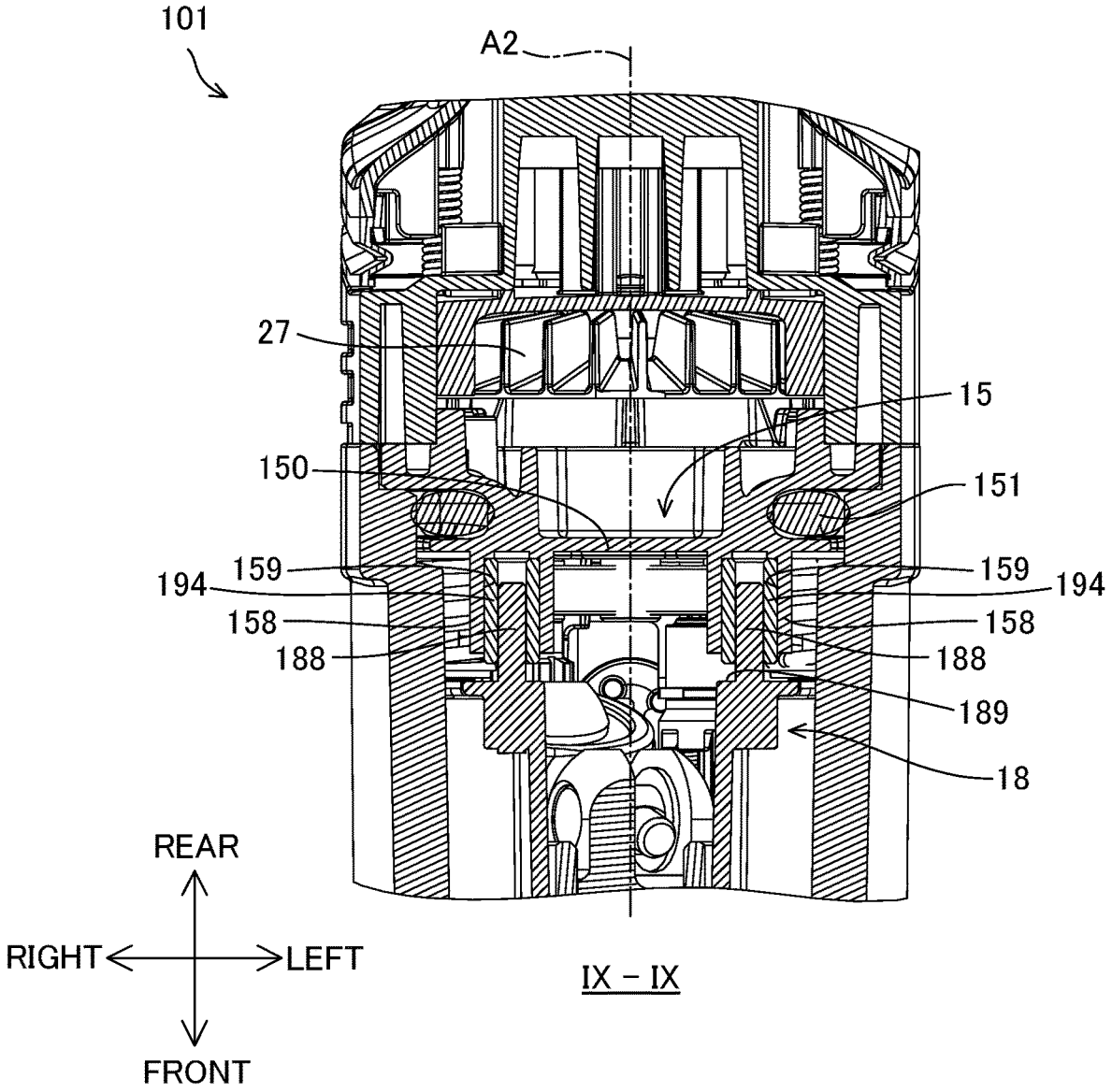
FIG. 9 is a sectional view taken along line IX-IX in FIG. 2, wherein the movable support is located in its foremost position.
Figure 10:
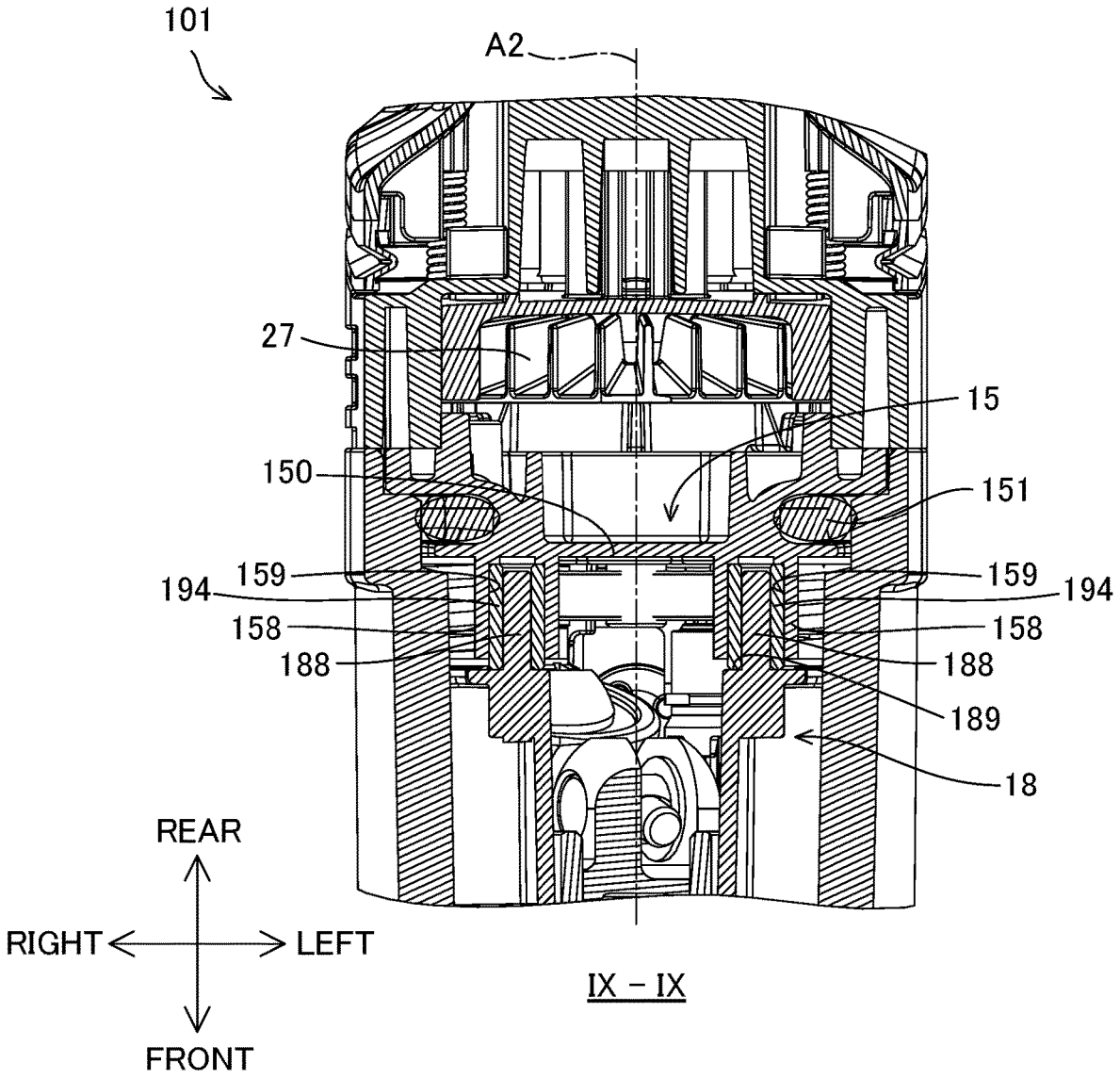
FIG. 10 is a sectional view taken along line IX-IX in FIG. 2, wherein the movable support is located in its rearmost position.

As shown in FIGS. 9 to 11, the first support 15 includes a pair of elastic-member-holding parts 158 each having a bottomed hollow circular cylindrical shape and extending frontward from the base 150. The pair of elastic-member-holding parts 158 are arranged to be bilaterally symmetrical. A hole 159 is formed in each elastic-member-holding part 158. As shown in FIG. 11, each elastic-member-holding part 158 extends more forward than the shaft-support part 156. An elastic member 194 having a hollow circular cylindrical shape is disposed in the hole 159 of each elastic-member-holding part 158. A rear end of the elastic member 194 abuts the base 150 while a front end of the elastic member 194 protrudes more frontward than a front end of the elastic-member-holding part 158. The elastic member 194 is held in a state fitted within the elastic-member-holding part 158. More specifically, an outer diameter of the elastic member 194 is slightly larger than an inner diameter of the elastic-member-holding part 158. The elastic member 194 is thus slightly pressed radially inward within the elastic-member-holding part 158 and therefore held within the hole 159 by the restorative force from the pressing. With such a structure, the elastic member 194 can be removably attached with ease. This in turn enables easy manufacturing and also allows easy replacement of an elastic member 194 when it is deteriorated or worn out.

As shown in FIGS. 9, 10, and 12, the movable support 18 includes a pair of projections 188 and an abutment part 189. Each projection 188 has a solid circular cylindrical shape and extends more rearward than the hollow circular cylindrical part 182. Each projection 188 is always received within the corresponding elastic member 194. An outer diameter of the projection 188 is slightly larger than an inner diameter of the elastic member 194. The elastic member 194 is thus slightly pressed radially outward, and therefore, the projection 188 and the elastic member 194 are always held in a state fitted with each other by the restorative force from the pressing. As the movable support 18 moves in the front-rear direction, the projection 188 slides on the inner surface of the elastic member 194 while being kept in the state fitted with the elastic member 194. The abutment part 189 is formed into an arch-shaped plane orthogonal to the front-rear direction, and is connected with base portions of the projections 188 at both ends of the arch.

When the movable support 18 is located in its foremost position shown in FIG. 7, the abutment part 189 of the movable support 18 is spaced apart from the front end portion of the elastic member 194 in the front-rear direction, as shown in FIG. 9. On the other hand, when the movable support 18 is located in its rearmost position shown in FIG. 8, the abutment part 189 of the movable support 18 abuts the front end portion of the elastic member 194 in the front-rear direction, as shown in FIG. 10. That is, the elastic member 194 serves as a stopper for restricting further rearward movement of the movable support 18. This structure thus defines the rearmost position of the movable support 18 shown in FIG. 8.

In the rotary hammer 101 described above, when the tool accessory 91 is pressed against a workpiece and the processing operation is performed in the hammer-drill mode and the hammer mode in which the hammering operation is performed, vibration is caused mainly in the front-rear direction in the striking mechanism 6 due to the force of the striking mechanism 6 driving the tool accessory 91 and a reaction force from the workpiece against the striking force of the tool accessory 91. Owing to this vibration, the movable unit 180 may move relative to the body housing 10 in the front-rear direction while being slidably guided by the first and second guide shafts 191 and 192. At this time, the biasing springs 193 expand and contract (elastically deform). This elastic deformation absorbs (attenuates) vibration from the movable unit 180 and thereby reduces the amount of vibration transmitted to the body housing 10 and the handle 17. Once the movable unit 180 has moved to its rearmost position, the abutment part 189 of the movable support 18 collides with and elastically deforms the elastic members 194. This elastic deformation also serves to absorb (attenuate) vibration from the movable unit 180.

According to the rotary hammer 101 described above, the bearings 411 and 421 for respectively supporting the front end portions of the first intermediate shaft 41 and the second intermediate shaft 42 are supported by the second support 16 formed of metal. This provides stronger support strength than in a case in which the bearings 411 and 421 are supported by a plastic support. Therefore, even if high power operation of the power tool results in increased vibration due to a reaction force produced against the striking force of the tool accessory 91, the positional accuracy for the bearings 411 and 421 and thus for the first intermediate shaft 41 and the second intermediate shaft 42 can be maintained at the required level. The effects can be further reinforced by the use of the first support 15 formed of metal to support the bearings 412 and 422 for supporting the respective rear end portions of the first intermediate shaft 41 and the second intermediate shaft 42.

Furthermore, according to the rotary hammer 101, the first guide shafts 191 are respectively partially received within the holes 166 (more specifically, holes of the sleeves 167) of the second support 16 formed of metal. Therefore, even if high power operation of the rotary hammer 101 results in an increased amount of heat produced as the first guide shafts 191 slidably guide movement of the movable support 18 in the front-rear direction, the second support 16 can have reduced thermal expansion compared to a case in which a plastic support is used to receive the first guide shafts 191. Therefore, the positional accuracy required for the first guide shafts 191 partially received in the holes 166 of the second support 16 can be maintained at the required level. This in turn provides satisfactory sliding property related to the first guide shafts 191 and also allows for satisfactory isolation of vibration. The effects can be further reinforced by having the second guide shafts 192 respectively partially received within the holes 184 (more specifically, holes of the sleeves 186) of the movable support 18 formed of metal.

As such, the rotary hammer 101 can achieve both high power operation and reduced vibration. Moreover, the use of the single member, namely the second support 16, for both supporting the bearings 411 and 421 and also for receiving the first guide shafts 191 enables simplified tool structure as well as reduced man-hours related to manufacturing.

Furthermore, the use of the elastic members 194 each serving as a stopper in the rotary hammer 101 can improve dissipation of heat produced due to sliding movement of the movable support 18 in the front-rear direction. Structures therefor are now described. As described above with reference to FIGS. 9 and 10, each elastic member 194 is disposed so as to be always in contact with the movable support 18 (more specifically, the projection 188) and the first support 15 (more specifically, the elastic-member-holding part 158) irrespective of where the movable support 18 is located in the front-rear direction.

An elastic material conductive of heat (e.g. conductive rubber) is used for the elastic members 194. Heat conductivity may be achieved by forming the elastic member 194 from a filler-containing elastic material. Examples of the filler include metal, carbon nanotube, and the like. Being "conductive of heat" may be defined as having a heat conductivity of not less than 1.0 W/m*K.

As described above, the first support 15 is formed of metal, and is disposed adjacent to the passage 16 for flow of air generated by rotation of the cooling fan 27. Therefore, the heat produced due to sliding movement of the movable support 18 in the front-rear direction can be transmitted via the heat conductive elastic member 194 to the first support 15 and then be dissipated efficiently by the flow of air generated by rotation of the cooling fan 27.

In this embodiment, the elastic member 194 and the corresponding projection 188 of the movable support 18 are always kept in a state fitted with each other. Therefore, the elastic member 194 and the movable support 18 can have a larger contact area compared to a case in which the members makes a plane contact with each other. This enables enhanced heat transmission from the movable support 18 to the elastic member 194 and thus provides further improved heat dissipation. Also, the elastic member 194 and the corresponding elastic-member-holding part 158 of the first support 15 are always kept in a state fitted with each other. Therefore, the elastic member 194 and the first support 15 can have a larger contact area compared to a case in which the members makes a planar contact with each other. This enables enhanced heat transmission from the elastic member 194 to the first support 15 and thus provides further improved heat dissipation. Moreover, the fitted states are implemented as a hollow circular cylindrical shape fitted with another hollow circular cylindrical shape or with a solid circular cylindrical shape. This enables easy manufacturing while achieving a larger contact area.

Furthermore, as shown in FIG. 11, the elastic members 194 are disposed adjacent to the second guide shafts 192. Therefore, heat can be transmitted over a short distance from where heat is produced due to sliding movement, via the movable support 18, and to the elastic member 194. This enables further efficient heat dissipation.

Furthermore, as shown in FIG. 11, in an imaginary plane orthogonal to the driving axis A1 (in other words, a surface where the base 150 spreads), the distance between one of the pair of second guide shafts 192 (the one on the right side) and one of the pair of elastic members 194 (the one on the right side) that is disposed adjacent to the second guide shaft 192 is equal to the distance between the other one of the pair of second guide shafts 192 (the one on the left side) and the other one of the pair of elastic member 194 (the one on the left side). Therefore, the length of heat transmission path from the one of the second guide shafts 192 to the one of the elastic members 194 is equal to the length of heat transmission path from the other one of the second guide shafts 192 to the other one of the elastic members 194 (such an arrangement is also referred to as an equidistant arrangement). This reduces or minimizes unevenness of temperature in the movable support 18 and thus enables uniform heat dissipation.

FIG. 11 shows an example of equidistant arrangement in which one elastic member 194 is provided for one second guide shaft 192. However, in alternative embodiments, multiple elastic members 194 may be provided for one second guide shaft 192. For example, in an embodiment in which two elastic members 194 are provided for one second guide shaft 192 (in this case, there are four elastic members 194 in total), the equidistant arrangement may be implemented such that each distance between one of the second guide shafts 192 and each one of its corresponding two elastic members 194 is equal to each distance between the other one of the second guide shafts 192 and each one of its corresponding two elastic members 194.

Correspondences between the features of the above-described embodiment and the features of the claims are as follows. The features of the above-described embodiment are, however, merely exemplary and do not limit the features of the present invention. The rotary hammer 101 is an example of the "power tool". The spindle 31 is an example of the "final output shaft". The driving axis A1 is an example of the "driving axis". The motor 2 and the motor shaft 25 are examples of the "motor" and the "motor shaft", respectively. The driving mechanism 5 is an example of the "driving mechanism". The body housing 10 is an example of the "housing". The movable support 18 is an example of the "movable support". The biasing spring 193 is an example of the "biasing member". The first guide shaft 191 and the second guide shaft 192 are examples of the "first guide shaft" and the "second guide shaft", respectively. The first intermediate shaft 41 and the second intermediate shaft 42 are examples of the "first intermediate shaft" and the "second intermediate shaft", respectively. The bearing 411 and the bearing 421 are examples of the "first bearing" and the "second bearing", respectively. The second support 16 is an example of the "metal support". The hole 166 and the hole 184 are examples of the "first hole" and the "second hole", respectively. The first positioning part 163 and the second positioning part 133 are examples of the "first positioning part" and the "second positioning part", respectively. The sleeve 167 and the sleeve 186 are examples of the "first sleeve" and the "second sleeve", respectively. The attachment surface 168 is an example of the "attachment surface".

The above-described embodiment is merely an exemplary embodiment of the present disclosure, and power tools, such as rotary hammers and hammer drills, according to the present disclosure are not limited to the rotary hammer 101 of the illustrated structure. For example, the following modifications may be made. One or more of these modifications may be employed in combination with the rotary hammer 101 of the above-described embodiment or any one of the claimed aspects.

Instead of the first intermediate shaft 41 and the second intermediate shaft 42, a single intermediate shaft may be used for both power transmission for hammering operations and power transmission for drilling operations. Such a structure is disclosed in, for example, US Patent Application NO. 2017/106517, the disclosed contents of all of which are hereby fully incorporated herein by reference.

The first guide shaft 191 may be fixedly received within the hole 166 of the second support 16, instead of being fixedly held to the movable support 18. In this modification, the first guide shaft 191 held by the second support 16 may be slidably received within a hole formed in the movable support 18.

The movable support 18, the elastic member 194, and the first support 15 may always be in contact with each other in an alternative manner. For example, the elastic-member-holding part 158 may have a solid circular cylindrical shape, the elastic member 194 may have a hollow circular cylindrical shape surrounding the elastic-member-holding part 158, and the projection 188 may have a hollow circular cylindrical shape surrounding the elastic member 194. Alternatively, the movable support 18, the elastic member 194, and the first support 15 may make a plane contact with each other.

The elastic member conductive of heat (the elastic member 194 in the above-described embodiment) may be disposed to be always in contact with the movable support 18 as well as a freely selected metal member disposed to be heat dissipative. In this modification, the metal member may extend from the front side of and through the first support 15 all the way until it reaches above the air flow passage 26. Alternatively, the metal member may be a freely selected member disposed to be at least partially exposed to outside the rotary hammer 101. For example, at least a portion of the body housing 10 exposed to the outside may be formed of metal, and this metal portion and the elastic member may be configured to be always in contact with each other.

In the above-described embodiments, the rotary hammer 101 capable of performing hammering operations and drilling operations is illustrated as an example of a power tool. However, the power tool may alternatively be an electric hammer (scraper, demolition hammer) capable of performing hammering operations only.

Further, to enhance dissipation of heat produced due to between-parts sliding movement, the following aspects 1 to 10 can be provided. Any one of the following aspects 1 to 10 can be employed on its own or in combination with any one or more others of the following aspects 1 to 10. Alternatively, at least one of the following aspects 1 to 10 may be employed in combination with the rotary hammer 101 of the above-described embodiment, its modifications described above, and the claimed features.

Aspect 1

A power tool comprising:

a final output shaft configured to removably hold a tool accessory and defining a driving axis of the tool accessory;

a motor including a motor shaft;

a driving mechanism configured to linearly reciprocally drive the tool accessory along the driving axis by using power from the motor;

a movable support at least partially supporting the final output shaft and the driving mechanism, the movable support being configured to be integrally movable relative to the motor in an axial direction of the driving axis;

a biasing member configured to bias the movable support toward a front side in the axial direction, the front side being defined as one side in the axial direction in which the final output shaft is disposed and a rear side being defined as an opposite side in the axial direction in which the motor is disposed;

at least one guide shaft extending in the axial direction and configured to slidably guide movement of the movable support in the axial direction;

a metal member disposed to be capable of dissipating heat;

at least one elastic member conductive of heat, the at least one elastic member being disposed to be always in contact with the movable support and the metal member irrespective of where the movable support is located in the axial direction.

According to the power tool of this Aspect, the at least one elastic member conductive of heat is always in contact with the movable support and also with the metal member disposed to be capable of dissipating heat. Therefore, heat produced due to sliding movement for guiding the movement of the movable support can be transmitted from the movable support to the metal member via the at least one elastic member and then be dissipated therefrom. This enhances dissipation of heat produced due to sliding movement for guiding the movement of the movable support.

Aspect 2

The power tool according to Aspect 1, wherein the metal member is disposed to be at least partially exposed to outside of the power tool.

According to this Aspect, heat transmitted from the movable support to the metal member can be dissipated with a simple structure. In this Aspect, the metal member may be a portion of a housing that defines an outer shell of the power tool.

Aspect 3

The power tool according to Aspect 1 or 2, further comprising a fan fixed to the motor shaft, wherein the metal member is disposed on a passage for flow of air generated by rotation of the fan or is disposed adjacent to the passage.

According to this Aspect, heat transmitted from the movable support to the metal member can be dissipated efficiently by flow of air generated by rotation of the fan.

Aspect 4

The power tool according to any one of Aspects 1 to 3, wherein:

the at least one elastic member is held by the metal support; and the movable support is configured to slide on the at least one elastic member while the movable support moves in the axial direction.

According to this Aspect, the at least one elastic member can always be in contact with the movable support and the metal support in an easily implemented manner.

Aspect 5

The power tool according to any one of Aspects 1 to 4, wherein the at least one elastic member and the movable support are always kept in a state fitted with each other.

According to this Aspect, the at least one elastic member and the movable support can have a larger contact area compared to a case in which the at least one elastic member and the movable support makes a plane contact with each other. This enables enhanced heat transmission from the movable support to the at least one elastic member and thus provides further improved heat dissipation.

Aspect 6

The power tool according to Aspect 5, wherein the at least one elastic member and the movable support are shaped such that the state in which the at least one elastic member and the movable support are fitted with each other is implemented as a hollow circular cylindrical shape fitted with another hollow circular cylindrical shape or a solid circular cylindrical shape.

This Aspect enables easy manufacturing while achieving a larger contact area between the at least one elastic member and the movable support.

Aspect 7

The power tool according to any one of Aspects 1 to 6, wherein the at least one elastic member is disposed adjacent to the at least one guide shaft.

According to this Aspect, heat can be transmitted over a short distance from a portion of the movable support where heat is produced due to sliding movement to the at least one elastic member. This enables efficient heat dissipation.

Aspect 8

The power tool according to any one of Aspects 1 to 7, wherein when the movable support moves rearwards in the axial direction, the at least one elastic member serves as a stopper by abutting the movable support in the axial direction and restricting further rearward movement of the movable support.

According to this Aspect, elastic deformation of the at least one elastic member when serving as a stopper functions to cushion a part of a reaction force from a workpiece due to the hammering operation of the tool accessory. This enhances isolation of vibration in the power tool. The tool can also achieve improved durability.

Aspect 9

The power tool according to any one of Aspects 1 to 8, wherein:

the at least one guide shaft includes a plurality of guide shafts;

the at least one elastic member includes a plurality of elastic members corresponding to the plurality of guide shafts; and the at least one guide shaft and the at least one elastic member are arranged such that each one of the plurality of guide shafts and its corresponding elastic member (which may be one or more) are separated by an equal distance on an imaginary plane orthogonal to the driving axis.

According to this Aspect, each one of the plurality of guide shafts and its corresponding elastic member(s) are separated by an equal distance (i.e. heat is transmitted over a path of equal distance). This reduces or minimizes unevenness of temperature in the movable support and thus enables uniform heat dissipation.

Aspect 10

The power tool according to any one of Aspects 1 to 9, wherein:

the metal support includes at least one hole; and the at least one elastic member is held in a state fitted within the at least one hole.

According to this Aspect, the at least one elastic member and the metal support can have a larger contact area compared to a case in which the at least one elastic member and the metal support makes a plane contact with each other. This enables enhanced heat transmission from the at least one elastic member to the metal support and thus provides improved heat dissipation. Furthermore, the at least one elastic member can be removably attached to the metal member with ease. This enables easy manufacturing and also allows for easy replacement of the at least one elastic member when it is deteriorated or worn out.

Correspondences between the features of the above-described embodiment and the features of Aspects 1 to 10 are as follows. The features of the above-described embodiment are, however, merely exemplary and do not limit the features of the present invention.

The rotary hammer 101 is an example of the "power tool". The spindle 31 is an example of the "final output shaft". The driving axis A1 is an example of the "driving axis". The motor 2 and the motor shaft 25 are examples of the "motor"

and the "motor shaft", respectively. The driving mechanism 5 is an example of the "driving mechanism". The movable support 18 is an example of the "movable support". The biasing spring 193 is an example of the "biasing member". The second guide shaft 192 (or the second guide shaft 192 and the first guide shaft 191) is an example of the "at least one guide shaft". The first support 15 is an example of the "metal support". The elastic member 194 is an example of the "at least one elastic member". The cooling fan 27 is an example of the "fan".

DESCRIPTION OF THE REFERENCE NUMERALS

2: motor, 5: driving mechanism, 6: striking mechanism, 7: rotation-transmitting mechanism, 10: body housing, 11: rear housing, 13: front housing, 15: first support, 16: second support, 17: handle, 18: movable support, 20: body, 25: motor shaft, 26: passage for flow of air, 27: cooling fan, 28: inlet opening, 29: discharge opening, 31: spindle, 32: tool holder, 33: cylinder, 41: first intermediate shaft, 42: second intermediate shaft, 61: motion-converting member, 63: intervening member, 64: first transmitting member, 65: piston, 67: striker, 68: impact bolt, 72: second transmitting member, 73: torque limiter, 74: drive-side member, 75: driven-side member, 77: biasing spring, 78: driving gear, 79: driven gear, 91: tool accessory, 101: rotary hammer, 131: barrel part, 132: auxiliary handle, 133: second positioning part, 135: attachment surface, 150: base, 151: O-ring, 152: groove, 153: through hole, 154, 155: bearing-support part, 156: shaft-support part, 158: elastic-member-holding part, 159: hole, 161: screw, 162: through hole, 163: first positioning part, 164, 165: bearing-support part, 166: hole, 167: sleeve, 168: attachment surface, 171: trigger, 172: switch, 179: power cable, 180: movable unit, 181, 182: hollow circular cylindrical part, 183, 184: hole, 185: spindle-support part, 186: sleeve, 187: rotary-body-support part, 188: projection, 189: abutment part, 191: first guide shaft, 192: second guide shaft, 193: biasing spring, 194: elastic member, 195: washer, 251, 252: bearing, 255: pinion gear, 316, 317: bearing, 330: bit-insertion hole, 411, 412: bearing, 414: first driven gear, 416: spline part, 421, 422: bearing, 423: gear member, 424: second driven gear, 425: spline part, 611: rotary body, 612: spline part, 614: bearing, 616: oscillating member, 617: arm, 631: spline part, 641: first spline part, 642: second spline part, 721: first spline part, 722: second spline part, 743: spline part, 800: mode-changing dial, A1: driving axis, A2, A3, A4: rotation axis, P1: imaginary plane.

What is claimed is:

1. A power tool comprising:

a final output shaft configured to removably hold a tool accessory and defining a driving axis of the tool accessory;

a motor including a motor shaft;

a driving mechanism configured to perform at least a hammering operation of linearly reciprocally driving the tool accessory along the driving axis by using power from the motor;

a housing accommodating the motor and the driving mechanism:

a movable support at least partially supporting the final output shaft and the driving mechanism, the movable support being configured to be integrally movable relative to the housing in an axial direction of the driving axis;

a biasing member configured to bias the movable support toward a front side in the axial direction, the front side being defined as one side in the axial direction in which the final output shaft is disposed while a rear side being defined as an opposite side in the axial direction in which the motor is disposed;

a first guide shaft extending in the axial direction and configured to slidably guide movement of the movable support in the axial direction;

at least one intermediate shaft extending in the axial direction and configured to rotate in response to rotation of the motor shaft and transmit the power of the motor to the driving mechanism;

at least one bearing supporting an end portion of the at least one intermediate shaft, the end portion being located in the front side in the axial direction; and a single metal support disposed to be immovable relative to the housing and supporting the at least one bearing, the single metal support having a first hole for partially receiving the first guide shaft.

2. The power tool as defined in claim 1, wherein:

the housing is formed of plastic; and the metal support is fixed to the housing.

3. The power tool as defined in claim 1, wherein:

the metal support includes a first positioning part in the front side, the first positioning part being disposed so as to circumferentially surround the final output shaft;

the housing includes a second positioning part, the second positioning part being disposed so as to circumferentially surround the final output shaft; and the first positioning part and the second positioning part are shaped to be fitted with to each other in the axial direction.

4. The power tool as defined in claim 3, wherein:

the metal support includes an attachment surface in the front side, the attachment surface spreading in form of a single plane at a position radially outward of the first positioning part; and the attachment surface abuts on the housing in the axial direction.

5. The power tool as defined in claim 1, wherein:

the first guide shaft is disposed to be at least partially in the front side of the movable support; and the power tool further includes a second guide shaft that is disposed so as to be at least partially in the rear side of the movable support and coaxial with the first guide shaft.

6. The power tool as defined in claim 5, wherein the first guide shaft extends frontward from the movable support and is configured to move together with the movable support in the axial direction.

7. The power tool as defined in claim 6, wherein:

the metal support includes a first sleeve within the first hole, the first sleeve being made of iron-based metal;

the first guide shaft is configured to slide on an inner peripheral surface of the first sleeve while the movable support moves in the axial direction; and the metal support is made of aluminum-based metal except for the first sleeve.

8. The power tool as defined in claim 5, wherein:

the movable support includes a second hole for partially receiving the second guide shaft and a second sleeve disposed within the second hole;

the second guide shaft is disposed so as to be immovable relative to the housing;

an inner peripheral surface of the second sleeve is configured to slide on the second guide shaft while the movable support moves in the axial direction; and the biasing member is disposed around the second guide shaft in the rear side of the movable support in the axial direction, and is configured to bias the movable support including the second sleeve integrally frontward.

9. The power tool as defined in claim 1, wherein:

the driving mechanism is further configured to perform a drilling operation of rotationally driving the tool accessory around the driving axis by using the power from the motor;

the at least one intermediate shaft includes a first intermediate shaft configured to transmit power for the hammering operation to the driving mechanism, and a second intermediate shaft configured to transmit power for the drilling operation to the driving mechanism;

the at least one bearing includes a first bearing for supporting the first intermediate shaft and a second bearing for supporting the second intermediate shaft;

the first intermediate shaft is configured to transmit the power for the hammering operation but not for the drilling operation; and the second intermediate shaft is configured to transmit the power for the drilling operation but not for the hammering operation.

10. The power tool as defined in claim 9, wherein the first bearing and the second bearing are disposed at positions different from each other in the axial direction.

11. The power tool as defined in claim 1, wherein:

the housing is formed of plastic;

the metal support is disposed to be at least partially exposed to outside of the power tool;

the first guide shaft is disposed to be at least partially in the front side of the movable support; and the power tool further includes a second guide shaft that is disposed so as to be at least partially in the rear side of the movable support and coaxial with the first guide shaft.

12. The power tool as defined in claim 1, wherein:

the housing is formed of plastic;

the metal support is fixed to the housing;

the driving mechanism is further configured to perform a drilling operation of rotationally driving the tool accessory around the driving axis by using the power from the motor;

the at least one intermediate shaft includes a first intermediate shaft configured to transmit power for the hammering operation to the driving mechanism, and a second intermediate shaft configured to transmit power for the drilling operation to the driving mechanism;

the at least one bearing includes a first bearing for supporting the first intermediate shaft and a second bearing for supporting the second intermediate shaft;

the first intermediate shaft is configured to transmit the power for the hammering operation but not for the drilling operation; and the second intermediate shaft is configured to transmit the power for the drilling operation but not for the hammering operation.

13. The power tool as defined in claim 1, wherein:

the first guide shaft is disposed to be at least partially in the front side of the movable support;

the power tool further includes a second guide shaft that is disposed so as to be at least partially in the rear side of the movable support and coaxial with the first guide shaft;

the driving mechanism is further configured to perform a drilling operation of rotationally driving the tool accessory around the driving axis by using the power from the motor;

the at least one intermediate shaft includes a first intermediate shaft configured to transmit power for the hammering operation to the driving mechanism, and a second intermediate shaft configured to transmit power for the drilling operation to the driving mechanism;

the at least one bearing includes a first bearing for supporting the first intermediate shaft and a second bearing for supporting the second intermediate shaft;

the first intermediate shaft is configured to transmit the power for the hammering operation but not for the drilling operation; and the second intermediate shaft is configured to transmit the power for the drilling operation but not for the hammering operation.

14. The power tool as defined in claim 1, wherein:

the housing is formed of plastic;

the metal support is fixed to the housing;

the first guide shaft is disposed to be at least partially in the front side of the movable support;

the power tool further includes a second guide shaft that is disposed so as to be at least partially in the rear side of the movable support and coaxial with the first guide shaft;

the driving mechanism is further configured to perform a drilling operation of rotationally driving the tool accessory around the driving axis by using the power from the motor;

the at least one intermediate shaft includes a first intermediate shaft configured to transmit power for the hammering operation to the driving mechanism, and a second intermediate shaft configured to transmit power for the drilling operation to the driving mechanism;

the at least one bearing includes a first bearing for supporting the first intermediate shaft and a second bearing for supporting the second intermediate shaft;

the first intermediate shaft is configured to transmit the power for the hammering operation but not for the drilling operation; and the second intermediate shaft is configured to transmit the power for the drilling operation but not for the hammering operation.

15. The power tool as defined in claim 1, wherein:

the first guide shaft is disposed to be at least partially in the front side of the movable support;

the power tool further includes a second guide shaft that is disposed so as to be at least partially in the rear side of the movable support and coaxial with the first guide shaft;

the first guide shaft extends frontward from the movable support and is configured to move together with the movable support in the axial direction;

the driving mechanism is further configured to perform a drilling operation of rotationally driving the tool accessory around the driving axis by using the power from the motor;

the at least one intermediate shaft includes a first intermediate shaft configured to transmit power for the hammering operation to the driving mechanism, and a second intermediate shaft configured to transmit power for the drilling operation to the driving mechanism;

the at least one bearing includes a first bearing for supporting the first intermediate shaft and a second bearing for supporting the second intermediate shaft;

the first intermediate shaft is configured to transmit the power for the hammering operation but not for the drilling operation; and the second intermediate shaft is configured to transmit the power for the drilling operation but not for the hammering operation.

16. The power tool as defined in claim 1, wherein:

the housing is formed of plastic;

the metal support is fixed to the housing;

the first guide shaft is disposed to be at least partially in the front side of the movable support;

the power tool further includes a second guide shaft that is disposed so as to be at least partially in the rear side of the movable support and coaxial with the first guide shaft;

the first guide shaft extends frontward from the movable support and is configured to move together with the movable support in the axial direction;

the driving mechanism is further configured to perform a drilling operation of rotationally driving the tool accessory around the driving axis by using the power from the motor;

the at least one intermediate shaft includes a first intermediate shaft configured to transmit power for the hammering operation to the driving mechanism, and a second intermediate shaft configured to transmit power for the drilling operation to the driving mechanism;

the at least one bearing includes a first bearing for supporting the first intermediate shaft and a second bearing for supporting the second intermediate shaft;

the first intermediate shaft is configured to transmit the power for the hammering operation but not for the drilling operation; and the second intermediate shaft is configured to transmit the power for the drilling operation but not for the hammering operation.

* * * * *